US008302951B2

(12) United States Patent
Watanabe et al.

(10) Patent No.: US 8,302,951 B2
(45) Date of Patent: Nov. 6, 2012

(54) SHEET PROCESSING APPARATUS AND IMAGE FORMING SYSTEM

(75) Inventors: Kiyoshi Watanabe, Matsudo (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 139 days.

(21) Appl. No.: 12/890,087

(22) Filed: Sep. 24, 2010

(65) Prior Publication Data

US 2011/0081183 A1 Apr. 7, 2011

(30) Foreign Application Priority Data

Oct. 7, 2009 (JP) ..... 2009-232998
Sep. 10, 2010 (JP) ..... 2010-202574

(51) Int. Cl.
*B31F 1/10* (2006.01)

(52) U.S. Cl. ..... 270/45; 270/32; 270/58.07

(58) Field of Classification Search ..... 270/32, 270/45, 58.07, 58.11; 493/406, 407, 442, 493/454

See application file for complete search history.

(56) References Cited

U.S. PATENT DOCUMENTS

| | | | | |
|---|---|---|---|---|
| 5,443,248 | A | 8/1995 | Hayashi et al. | |
| 5,735,515 | A | 4/1998 | Hayashi et al. | |
| 5,951,000 | A | 9/1999 | Sato et al. | |
| 6,692,208 | B1 | 2/2004 | Watkiss et al. | |
| 6,905,118 | B2 * | 6/2005 | Yamada et al. | 270/8 |
| 7,594,645 | B2 * | 9/2009 | Suzuki et al. | 270/37 |
| 7,607,650 | B2 * | 10/2009 | Oikawa et al. | 270/58.07 |
| 7,681,872 | B2 | 3/2010 | Hayashi | |
| 2005/0189688 | A1 * | 9/2005 | Suzuki et al. | 270/32 |
| 2006/0263174 | A1 * | 11/2006 | Oikawa et al. | 412/33 |
| 2008/0101836 | A1 | 5/2008 | Fujita et al. | |

FOREIGN PATENT DOCUMENTS

| | | | |
|---|---|---|---|
| EP | 1138521 | A2 | 10/2001 |
| ES | 2249235 | | 4/2006 |
| GB | 2360013 | B | 11/2002 |

* cited by examiner

*Primary Examiner* — Leslie A Nicholson, III

(74) *Attorney, Agent, or Firm* — Fitzpatrick, Cella, Harper & Scinto

(57) ABSTRACT

A sheet processing apparatus includes a holding portion that nips and holds a booklet, which includes folded sheets, by a pair of holding members opposite to each other, and a pressing portion that enters a gap between the pair of holding members to press a spine of the booklet held by the holding portion while moving along the spine of the booklet so as to deform the spine of the booklet, wherein the pressing portion changes its moving direction along the spine of the booklet and changes the pressing position thereof in the thickness direction of the booklet held between the pair of holding members, when the pressing portion deforms the spine of the booklet.

18 Claims, 21 Drawing Sheets

654a
658a
656a
641a
653a
649a
644
631
652a
S
649b
655a
641b
658b
656b 654a
658a
653a
656a
641a
631
649a
644
652a
649b
S
641b
656b
655a
658b 654a
656a
653a
631
656a
652a
651
S
655a
658b
656b 656a
654a
658a
641a
653a
651
644
631
652a
S
649b
655a
641b
658b
656b

SHEET PROCESSING APPARATUS AND IMAGE FORMING SYSTEM

BACKGROUND OF THE INVENTION

1. Field of the Invention

The present invention relates to a sheet processing apparatus and an image forming system that deforms a spine of a booklet made of a folded sheet bundle.

2. Description of the Related Art

Conventionally, when a sheet bundle including about 20 or more sheets is folded at a time, a booklet is formed having a vicinity of a spine being curved. The folded state of the booklet including the sheet bundle folded as described above is insufficient, so that the booklet is soon opened even after it is folded. Therefore, the appearance is degraded. The booklet described above cannot lie flat, so that it is difficult to stack a great number of booklets.

In order to solve the problem described above, there has been proposed a method and an apparatus of squaring a spine of a booklet as one of deforming processes (U.S. Pat. No. 6,692,208).

According to a conventional apparatus illustrated in FIGS. 20A to 20F, a booklet 701 is conveyed by conveying portions 706 and 707 with a spine of the booklet 701 set to the leading position, and the spine of the booklet 701 comes into contact with a positioning portion 705 for positioning (FIG. 20B). Then, as illustrated in FIG. 20C, grip portions 702 and 703 nip the adjacent portion of the spine of the booklet 701, and the positioning portion 705 is retracted. A pressing roller 704 travels along the spine of the booklet 701, which projects from the grip portions 702 and 703 and which is curved, so as to apply pressure. In this manner, the curved spine of the booklet 701 is squared.

FIG. 20A is a schematic diagram illustrating the traveling direction of the pressing roller 704. The pressing roller 704 is retracted to an area where it is not in contact with the booklet 701, before the grip portions 702 and 703 nip the booklet 701. When the grip portions 702 and 703 nip and hold the booklet 701, the pressing roller 704 moves from one end to the other end of the booklet 701 as applying pressure to the spine.

FIG. 20E illustrates the spine, which is pressed and squared, of the booklet 701, while FIG. 20D illustrates the state in which the booklet, which has already been subject to the deforming (squaring) process, is discharged onto a discharge tray 708.

However, since the spine, which projects from the grip portions 702 and 703, of the booklet 701 is pressed, the deformed portions 709*a* and 709*b* of the spine, which are subject to the deforming process, might protrude outward as illustrated in FIG. 20F, when the protruding amount is great. This gives less attractive appearance.

FIG. 21 illustrates the spine of the booklet that is subject to the squaring process in which the spine of the booklet is pressed to be deformed into a rectangular shape. The corners 709*a* and 709*b* of the squared spine spread in the thickness direction of the booklet, so that the width of the squared plane unfavorably becomes greater than the thickness of the booklet. Further, the sheet spine 709*c* at the center of the booklet, which does not have to be normally squared, is unfavorably deformed.

SUMMARY OF THE INVENTION

The present invention is accomplished in view of the above-mentioned problem, and aims to highly-attractively perform a deforming (squaring) process to a spine of a folded booklet in such a manner that the spine is not greater than the thickness of the booklet.

A sheet processing apparatus to achieve the foregoing object includes a holding portion that nips and holds a booklet, which includes folded sheets, by a pair of holding members opposite to each other, and a pressing portion that enters a gap between the pair of holding members to press a spine of the booklet held by the holding portion while moving along the spine of the booklet so as to deform the spine of the booklet, wherein the pressing portion changes its moving direction along the spine of the booklet and changes the pressing position thereof in the thickness direction of the booklet held between the pair of holding members, when the pressing portion deforms the spine of the booklet.

Further features of the present invention will become apparent from the following description of exemplary embodiments with reference to the attached drawings.

DESCRIPTION OF THE EMBODIMENTS

In the following, exemplary embodiments of the present invention will be described in detail exemplarily with reference to the drawings. Here, dimensions, materials, shapes, relative arrangements thereof and the like described in the following embodiments are to be appropriately modified according to a configuration of an apparatus to which the present invention is applied and various conditions. Therefore, unless otherwise specified, the scope of the present invention is not to be limited thereto.

In the present embodiment, an image forming system having an image forming apparatus main body and a sheet processing apparatus will be described as being exemplified. A sheet processing apparatus including a finisher 500, a saddle stitch binding portion 800, and a squaring processing portion 600 is illustrated as an example of the sheet processing apparatus. The sheet processing apparatus is not limited to the one described above. The sheet processing apparatus has an integrated configuration by various combinations of the finisher 500, the saddle stitch binding portion 800, the squaring processing portion 600, and other processing portions.

(Configuration of Image Forming System)

Figure 1:
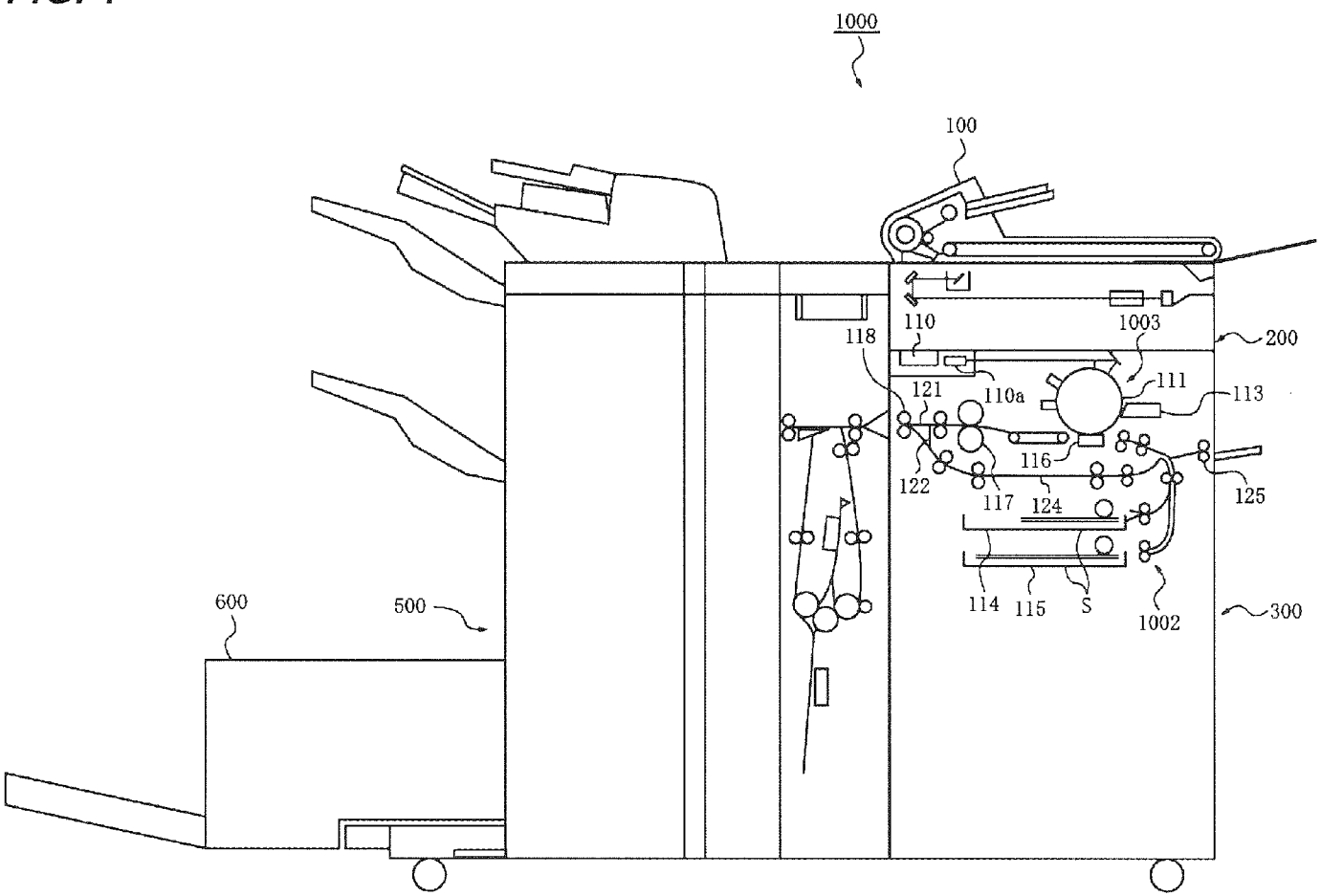
FIG. 1 is a sectional view illustrating an overall configuration of an image forming system.
Figure 2:
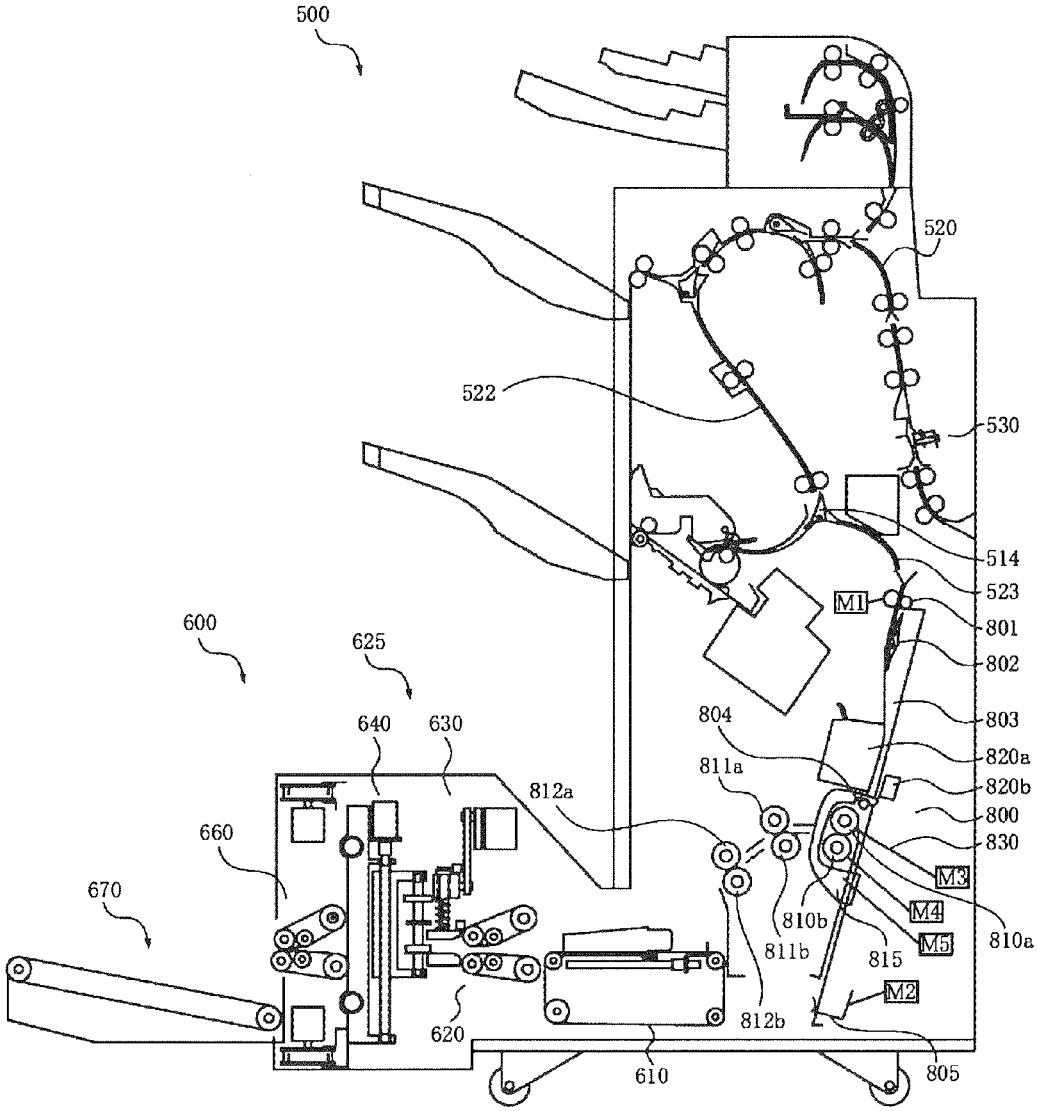
FIG. 2 is a sectional view of a configuration of a finisher.

First, a general configuration of the image forming system is described with reference to FIGS. 1 and 2. FIG. 1 is a sectional view illustrating an overall configuration of a main part of an image forming system. FIG. 2 is a sectional view illustrating a main part of a sheet processing apparatus.

As illustrated in FIGS. 1 and 2, the image forming system 1000 includes an image forming apparatus main body 10 and a sheet processing apparatus 20. The sheet processing apparatus 20 includes a finisher 500, a saddle stitch binding portion 800, and a squaring processing portion 600. The saddle stitch binding portion 800 and the squaring processing portion 600 can be mounted as an option. The image forming apparatus main body 10 includes a document feed portion 100, an image reader 200 to read an image of a document and a printer 300 to record an image on a sheet.

(Configuration of Image Forming Apparatus Main Body)

A document is conveyed to a reading position by the document feed portion 100, and image data of the document read at the reading position by the image reader 200 is sent to an exposure controlling portion 110 with a predetermined imaging process performed thereto. The exposure controlling portion 110 outputs a laser beam according to an image signal. The laser beam is irradiated on a photosensitive drum 111 as being scanned by a polygon mirror 110*a*. An electrostatic latent image according to the scanned laser beam is formed at the photosensitive drum 111 constituting an image forming portion 1003. The electrostatic latent image formed on the photosensitive drum 111 is developed by a development device 113, and made visible as a toner image.

On the other hand, a sheet is conveyed to a transfer portion 116 from any one of cassettes 114 and 115, a manual feed portion 125, and a duplex conveying path 124, those of which constitute a feed portion 1002. The toner image, which is made visible, is transferred onto the sheet at the transfer portion 116. The sheet after the transfer is subject to a fixing process at a fixing portion 117.

The sheet passing through the fixing portion 117 is temporarily guided to a path 122 by a changeover member 121, and after the trailing end of the sheet completely passes through the changeover member 121, the sheet is switched back to be guided to a discharge roller 118 by the changeover member 121. The sheet is then discharged from the printer 300 by the discharge roller 118. Thus, the sheet is discharged from the printer 300 in a state that the surface having the toner image formed thereon faces downward (face-down). This discharge mode is called reverse discharge.

The sheet is discharged from the apparatus with the face-down state as described above, whereby an image forming process is performed one by one from a head page. In this case, the order of pages can be registered when the image forming process is performed by using the document feed portion 100 or when the image forming process is performed to image data from the computer.

When the image forming process is performed on both surfaces of the sheet, the sheet is directly guided toward the discharge roller 118 from the fixing portion 117, and immediately after the trailing end of the sheet completely passes through the changeover member 121, the sheet is switched back to be guided to the duplex conveying path 124 by the changeover member 121. The sheet guided to the duplex conveying path 124 is again fed between the photosensitive drum 111 and the transfer portion 116 as described above.

(Configuration of Sheet Processing Apparatus)

The sheet discharged from the printer 300 of the image forming apparatus main body 10 is sent to the finisher 500 constituting the sheet processing apparatus (sheet processing portion) 20.

The configuration of the finisher 500 will next be described with reference to FIGS. 1 and 2.

(Finisher)

The finisher 500 takes in the sheets discharged from the printer 300 by the discharge roller 118 and selectively performs a process to the sheet. The processes to the sheet include a process in which plural sheets taken in the finisher are aligned and bound up as one sheet bundle, a stapling process (binding process) of stapling a trailing end of the sheet bundle, a sorting process, and a non-sorting process. These sheet processes are selectively performed.

As illustrated in FIG. 2, the finisher 500 has a conveying path 520 that takes the conveyed sheet into the apparatus, wherein the sheet is conveyed to a lower discharge path 522 that feeds the sheet to the saddle stitch binding portion 800. The conveying path 520 is provided with a punch unit 530 that performs a punching process to the trailing end of the conveyed sheet, according to need, and plural pairs of conveying rollers.

A changeover member 514 is provided on the lower discharge path 522. The sheet guided to a saddle discharge path 523 is sent to the saddle stitch binding portion 800 by the changeover of the changeover member 514.

(Saddle Stitch Binding Portion)

Next, a configuration of the saddle stitch binding portion 800 will be described.

A sheet fed to the saddle stitch binding portion 800 is accepted by a pair of saddle inlet rollers 801, wherein a carry-in port is selected by a changeover member 802, which is operated by a solenoid, according to a size, and then, the sheet is carried in an accommodating guide 803 in the saddle stitch binding portion 800. The carried sheet is conveyed until the leading end thereof comes into contact with a movable sheet positioning member 805 by a slide roller 804. A motor M1 drives the pair of saddle inlet rollers 801 and the slide roller 804. A stapler 820 is provided at the middle of the accommodating guide 803 so as to be arranged across the accommodating guide 803. The stapler 820 is divided into a driver 820*a* that projects staples and an anvil 820*b* that bends the projected staples. The sheet positioning member 805 stops at the portion where the central portion of the sheet in the sheet conveying direction is located at the binding position of the stapler 820, when the sheet is carried in. The sheet positioning member 805 is movable through the drive of a motor M2, and changes its position according to a sheet size (length in the conveying direction).

A pair of folding rollers 810*a* and 810*b* is provided at the downstream side of the stapler 820. A projecting member 830 is provided at the position opposite to the pair of folding rollers 810*a* and 810*b* through the accommodating guide 803.

The position where the projecting member 830 retracts from the accommodating guide 803 is specified as a home position. The projecting member 830 projects toward an accommodated sheet bundle, including plural sheets, by the drive of a motor M3. Thus, the sheet bundle is folded as being pushed into a nip between the pair of folding rollers 810*a* and 810*b*. Thereafter, the projecting member 830 returns again to the home position. Pressure sufficient for making a fold to the sheet bundle is applied between the pair of folding rollers 810*a* and 810*b* by a spring (not illustrated). The sheet bundle having the fold formed thereon is discharged toward a squaring processing portion 600 through a pair of first fold conveying rollers 811*a* and 811*b* and a pair of second fold conveying rollers 812*a* and 812*b*. Pressure sufficient for conveying and stopping the sheet bundle, on which the fold is formed, is applied respectively to the pair of first fold conveying rollers 811*a* and 811*b* and the pair of second fold conveying rollers 812*a* and 812*b*. The pair of folding rollers 810*a* and 810*b*, the pair of first fold conveying rollers 811*a* and 811*b*, and the pair of second fold conveying rollers 812*a* and 812*b* are rotated at the constant speed by the same motor M4.

When the sheet bundle is folded without performing the binding process, the sheet bundle is moved such that the center portion of the sheet bundle, accommodated in the accommodating guide 803, in the conveying direction is located at the nip position of the pair of folding rollers 810*a* and 810*b*. On the other hand, when the sheet bundle bound by the stapler 820 is folded, the sheet bundle at the stapling position is moved such that the stapling position (center portion in the conveying direction) of the sheet bundle is located at the nip position between the pair of folding rollers 810*a* and 810*b* after the stapling process is completed. With this process, the sheet bundle can be folded with the position where the stapling process is performed being defined as a center.

A pair of aligning plates 815, which surrounds the outer periphery of the pair of folding rollers 810*a* and 810*b* and which has a surface projecting to the accommodating guide 803, is provided at the position of the pair of folding rollers 810*a* and 810*b*. The pair of aligning plates 815 receives the drive of a motor M5 to move in the width direction, which is orthogonal to the conveying direction of the sheet, whereby the sheet accommodated in the accommodating guide 803 is aligned (positioned) in the width direction of the sheet.

The double-folded sheet bundle (folded sheet bundle: hereinafter referred to as a booklet) S is formed by the saddle stitch binding portion 800 thus configured. The booklet is not limited thereto, and includes the double-folded sheet bundle without performing the binding process.

(Squaring Processing Portion)

Figure 4:
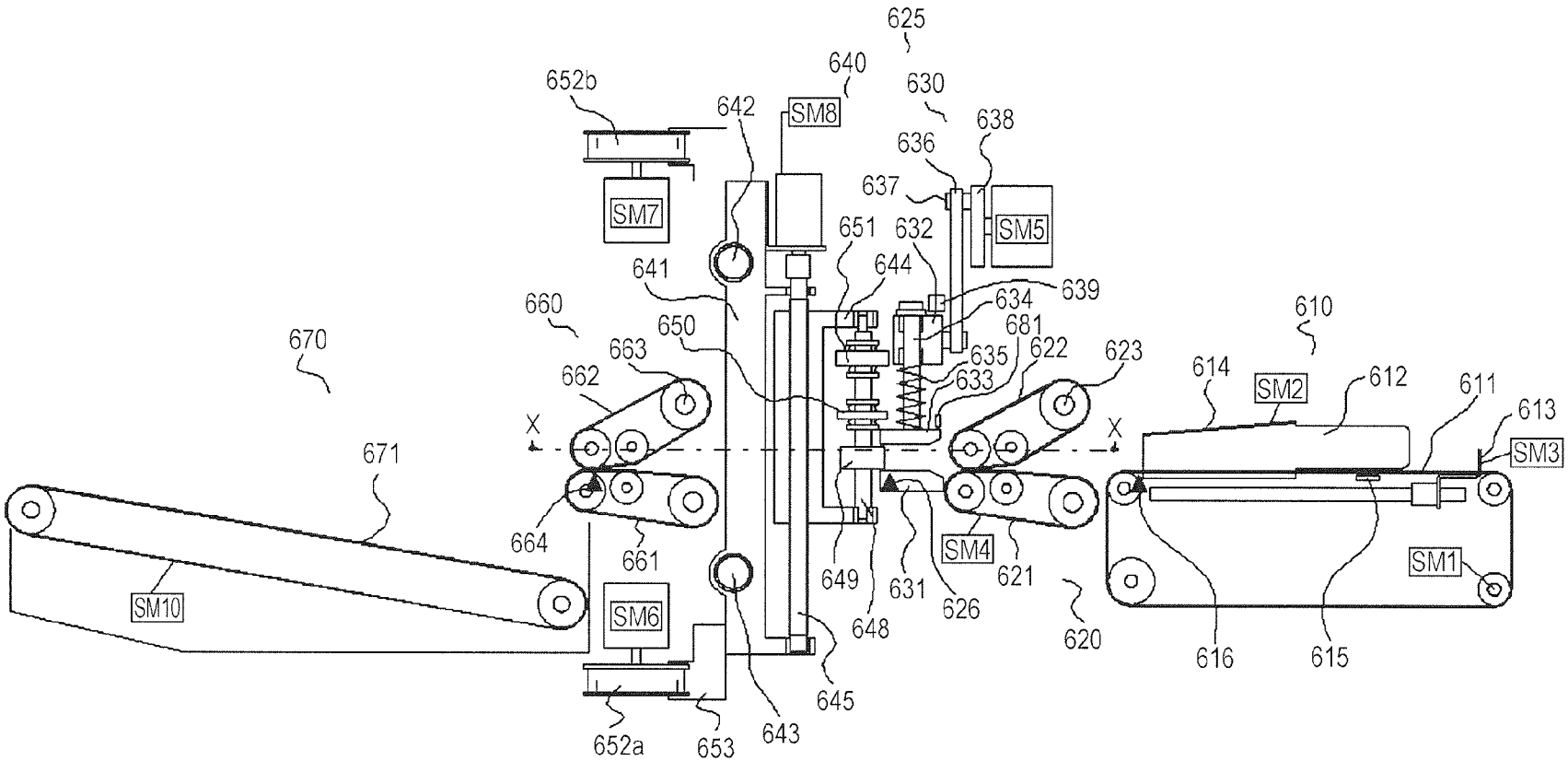
FIG. 4 is a sectional view illustrating a configuration of a squaring processing portion.

The squaring processing portion 600 will be described with reference to FIG. 4. FIG. 4 is an enlarged view of the squaring processing portion 600 in FIG. 2. The squaring processing portion 600 is located at the downstream side of the saddle stitch binding portion 800.

As illustrated in FIG. 4, in the squaring processing portion 600, a receiving portion 610 has a lower conveying belt 611 that extends in the conveying direction only at the lower part for receiving and conveying the booklet from the saddle stitch binding portion 800. When the booklet is received, the lower conveying belt 611 rotates in the conveying direction. Therefore, even if the booklet drops from the pair of second fold conveying rollers 812*a* and 812*b*, the lower conveying belt 611 can receive the booklet with the posture kept as it is conveyed without allowing the booklet to rotate.

A pair of side guides 612 is arranged at the outside of the lower conveying belt 611 across the lower conveying belt 611. The pair of side guides 612 operates in the width direction of the booklet (in the direction orthogonal to the conveying direction), thereby being capable of correcting the position of the booklet in the width direction. A pressing guide 614 for preventing the booklet being opened is formed at the upper part of the pair of side guides 612. The pressing guide 614 functions as a guide for smoothly feeding the booklet to the downstream side. A conveying projection 613 that moves parallel to the lower conveying belt 611 is arranged at both sides of the lower conveying belt 611. The conveying projection 613 moves in the forward and reverse directions with the speed substantially equal to the speed of the lower conveying belt 611. When a slippage is produced between the lower conveying belt 611 and the booklet, the conveying projection 613 comes into contact with the trailing end of the booklet to surely push the trailing end of the booklet toward the downstream side. The lower conveying belt 611, the pair of side guides 612, and the conveying projection 613 respectively operate through drives of the motors SM1, SM2, and SM3.

In the squaring processing portion 600, the conveying portion 620 includes a lower conveying belt 621 and an upper conveying belt 622 for receiving the booklet from the receiving portion 610 and for conveying the same toward the downstream side. The upper conveying belt 622 can pivot about a supporting point 623 according to a thickness of the booklet. The upper conveying belt 622 is pressed against the lower conveying belt 621 by a spring (not illustrated). The upper and lower conveying belts 621 and 622 are driven by a motor SM4. An inlet detection sensor 615 detects that the booklet is received from the saddle stitch binding portion 800, and that the booklet is on the lower conveying belt 611. An outlet detection sensor 616 detects the booklet to output an input signal for operating the pair of side guides 612 and the conveying projection 613.

In the squaring processing portion 600, a deforming processing unit 625 includes a holding unit 630 that nips and holds the vicinity of the spine of the booklet in the vertical direction (thickness direction), and a squaring unit 640 that positions the spine of the booklet and presses the spine of the booklet through the application of pressure to perform squaring.

The holding unit 630 serving as a holding portion is divided into an upper unit that moves in the vertical direction and a lower holding plate 631 that is fixed to a frame so as to be opposite to the upper unit. The upper unit includes a strong holding base 632 that receives drive of a motor SM5 to move in the vertical direction through links 636, 637, and 638, and an upper holding plate 633 that is coupled by a slide coupling member 634, wherein a compression spring 635 is arranged at the outer periphery of the slide coupling member 634. The holding plates 631 and 633, which serve as a pair of holding members, constitute a holding portion that nips and holds the booklet, including folded sheets, between holding surfaces that are parallel to each other and opposite to each other. When the holding base 632 is at the upper position, the upper and lower holding plates 631 and 633 are separated from each other, wherein the booklet is conveyed between the upper and lower holding plates 631 and 633. When the holding base 632 is at the lower position, the booklet is firmly nipped and held by the upper and lower holding plates 631 and 633 by the compression spring 635 that is expanded and compressed according to the thickness of the booklet. Since the contact surfaces to the booklet (holding surfaces) of the upper and lower holding plates 631 and 633 are smooth surfaces having no projection, a press-contact mark cannot be formed on the booklet when the booklet is nipped and held. A top dead center detection sensor 639 detects that the holding base 632 is at the upper position. A thickness detection sensor (thickness detection portion) 681 detects the position of the upper holding plate 633 when the booklet is fixed (nipped and held), thereby calculating the gap between the holding surfaces to obtain the thickness of the held booklet.

Figure 5:
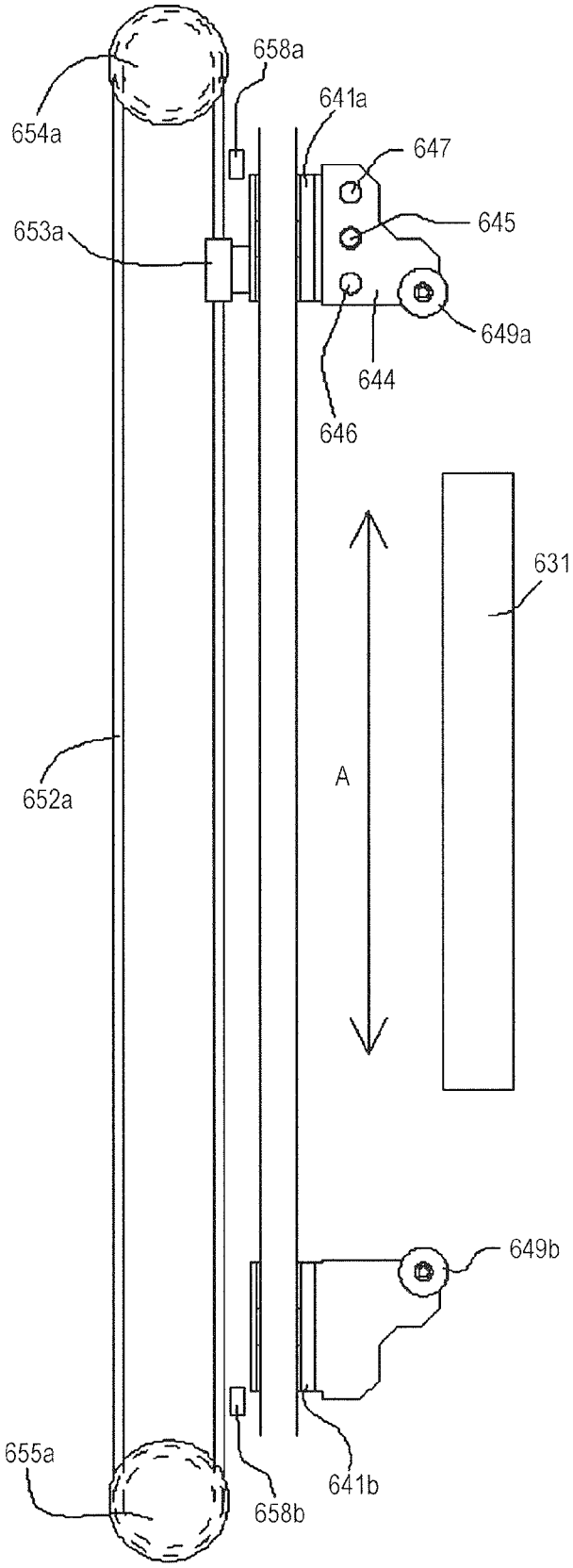
FIG. 5 is a top view of a squaring unit.

Next, the squaring unit 640 will be described with reference to FIGS. 4, 5, and 6. FIG. 5 is a view taken along a line X-X in FIG. 4, and FIG. 6 is a view when the squaring unit 640 in FIG. 4 is seen from the right side.

Figure 6:
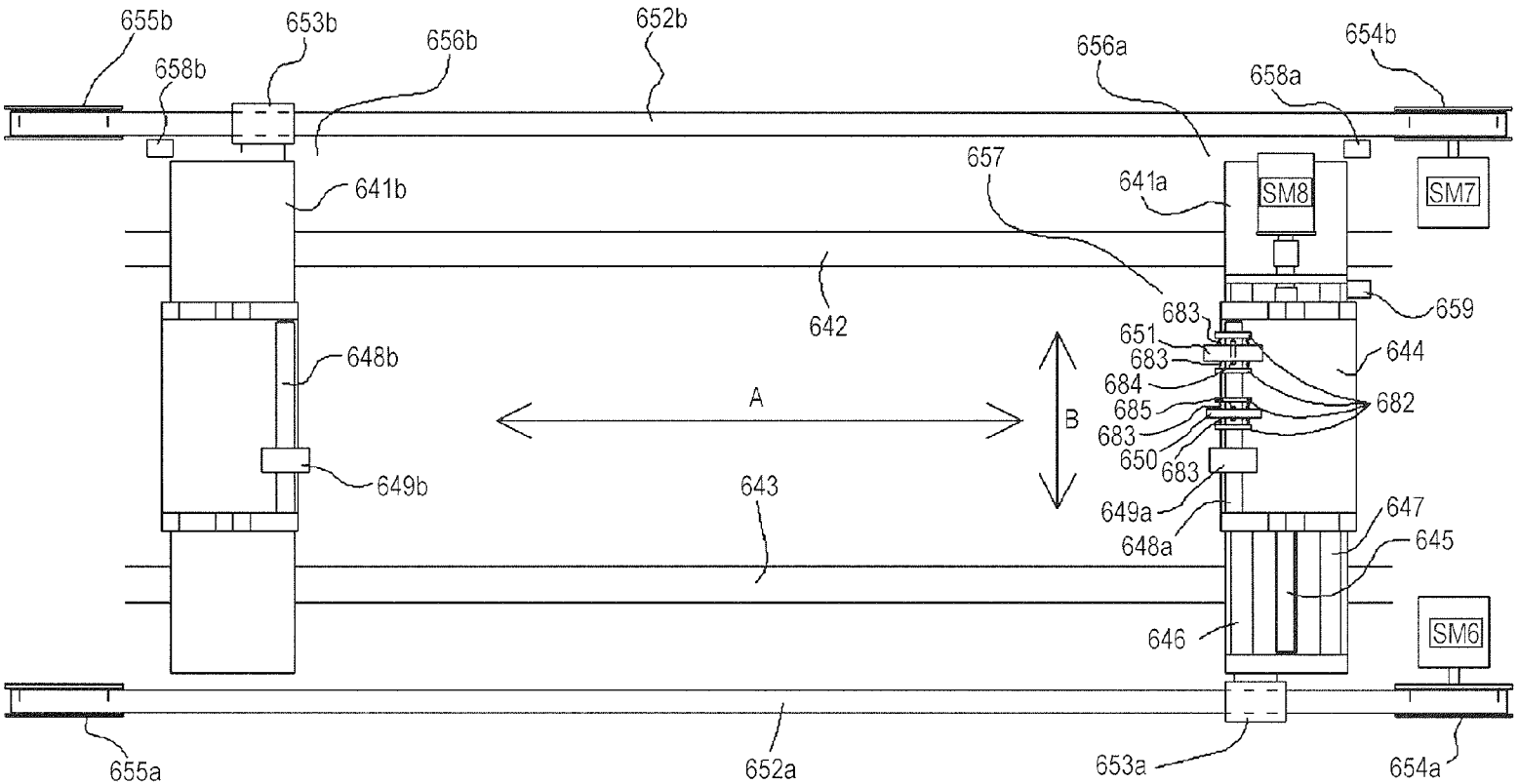
FIG. 6 is a front view of the squaring unit.

The squaring unit 640 is provided with a moving unit 656*a*, which is supported so as to be movable in a direction indicated by an arrow A in FIGS. 5 and 6 along slide shafts 642 and 643 that are supported by a frame (not illustrated). The moving unit 656*a* is mounted to a timing belt 652*a* by a coupling member 653*a*, and driven by a motor SM6 through pulleys 654*a* and 655*a*. The moving unit 656*a* has a moving base 641*a*, wherein a changeover unit 657 is slidably supported by slide shafts 646 and 647 fixed to the moving base 641*a*. The changeover unit 657 can move in a direction of B (vertical direction, thickness direction) in FIG. 6 along the slide shafts 646 and 647 by a slide screw 645 and a motor SM8. In the changeover unit 657, a support shaft 648*a* is mounted to a changeover base 644 so as to be rotatable. A spring receiving plate 682 and a stopper member 649*a* are fixed to the support shaft 648*a*. A first pressing member 650 and a second pressing member 651 are supported by the support shaft 648*a* so as to be capable of being equalized in such a manner that they are balanced by a spring 683 mounted to the spring receiving plate 682. The first pressing member 650 and the second pressing member 651 are mounted such that they can move in a thrust direction of the support shaft 648*a* but they are fixed by keys 684 and 685 in a radial direction. The stopper member 649*a* is a positioning portion that positions, in cooperation with a later-described stopper member 649*b*, the booklet at a predetermined location where the squaring process, which is a deforming process of the spine, is performed, through the abutment of the spine of the conveyed booklet to the stopper member 649*a*. The first pressing member 650 and the second pressing member 651 constituting the pressing portion is a pressing member that performs the squaring process in which the spine of the booklet is pressed to be deformed into a rectangular shape. The first pressing member 650 and the second pressing member 651 are changed by the movement of the changeover unit 657 in the direction of B in FIG. 6 according to the thickness of the booklet. The changed pressing member can displace the position of the pressing member in the thickness direction (in the direction of B) according to the thickness of the booklet, when the squaring process is performed. The changeover unit 657 has a reference position detection sensor 659, which becomes a reference position when the changeover unit 657 moves in the direction of B.

The squaring unit 640 also has a moving unit 656*b*, which is supported so as to be movable in the direction indicated by the arrow A in FIGS. 5 and 6 along the slide shafts 642 and 643 that are supported by the frame (not illustrated). The moving unit 656*b* is mounted to a timing belt 652*b* by a coupling member 653*b*, and driven by a motor SM7 through pulleys 654*b* and 655*b*. The moving unit 656*b* has a moving base 641*b*, wherein a support shaft 648*b* is mounted to the moving base 641*b* so as to be rotatable, and a stopper member 649*b* is fixed to the support shaft 648*b*. The stopper member 649*b* is a positioning portion that positions, in cooperation with the stopper member 649*a*, the booklet at a predetermined location where the squaring process, which is a deforming process of the spine, is performed, through the abutment of the spine of the conveyed booklet to the stopper member 649*b*. The stopper members 649*a* and 649*b* are mounted in such a manner that they position the location of the conveyed booklet S in the sheet conveying direction, and that receive the booklet S at the position separated from each other by a predetermined gap in the sheet width direction in order to correct the tilt of the booklet S. The location of the spine of the booklet, which is positioned by the stopper members 649*a* and 649*b*, is at the position inward from the end portions of the upper and lower holding plates 631 and 633, which serve as the pair of holding members constituting the holding portion, by a predetermined amount.

The moving units 656*a* and 656*b* are respectively provided with reference position detection sensors 658*a* and 658*b*, which become reference positions when the squaring unit 640 moves in the direction of A in the figure. The direction of A is orthogonal to the conveying direction of the booklet, and is along the spine of the booklet.

The stopper members 649*a* and 649*b*, the first pressing member 650, and the second pressing member 651 are members having a disk-like shape, and they have the relationship in size as illustrated in FIG. 7. As illustrated in FIGS. 7A and 7B, the diameter of each of the stopper members 649*a* and 649*b* is D1. The stopper members 649*a* and 649*b* enters the gap between the holding surfaces of the upper and lower holding plates 631 and 633 so as to position the booklet S1 at the predetermined location where the booklet S1 does not protrude from the end portion of the upper and lower holding plates 631 and 633 at the downstream side in the conveying direction. The thickness of each of the stopper members 649*a* and 649*b* is H1, which is higher than the thickness of the conveyed booklet S, so that even a thick booklet can be positioned in such a manner that the spine thereof does not go over the stopper member.

Figure 7E:
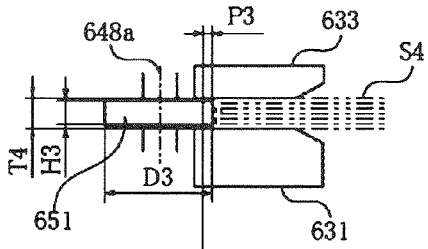
FIGS. 7A to 7F are enlarged views of essential parts illustrating the relationship between the gap between holding surfaces of holding plates and each member.
Figure 7F:
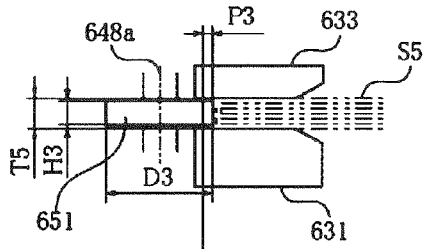
Figure 7C:
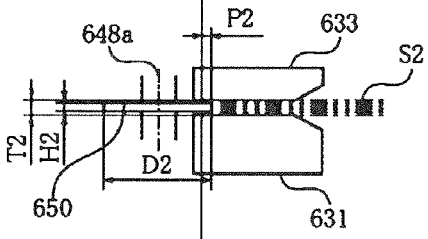
Figure 7D:
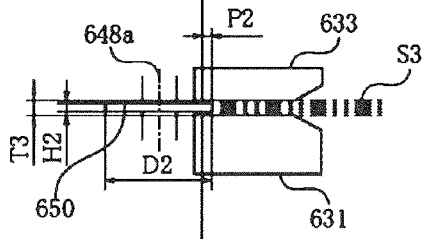
Figure 7A:
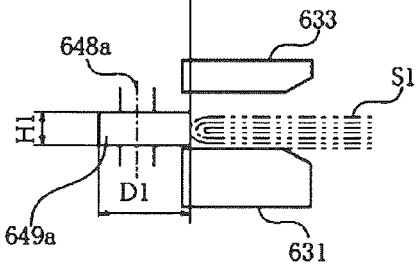
Figure 7B:
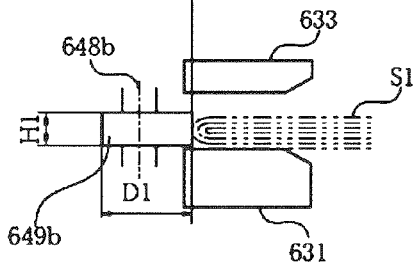

Here, a booklet formed by folding a single sheet in two to a booklet formed by folding 25 sheets in two are illustrated as the booklet formed by the saddle stitch binding portion 800. Among the booklets, the booklets formed by folding 1 to 10 sheets in two are not subject to the deforming (squaring) process, while the booklets formed by folding 11 to 25 sheets in two are subject to the deforming (squaring) process. This is because the booklets formed by folding 1 to 10 sheets in two have a small thickness, so that the process area (pressing amount) for performing the squaring process to the spine is difficult to be secured, and because the ease of opening the booklet is unchanged even if the squaring process is performed. The booklets formed by folding 11 to 25 sheets in two are subject to the squaring process. In this case, the width of the booklet varies, so that the squaring process is performed with the thickness of the booklet classified into plural stages (here, two stages). When the thickness of the booklet is within T2 to T3, the pressing member is changed to the first pressing member 650 having the thickness of H2 as illustrated in FIGS. 7C and 7D, while the pressing member is changed to the second pressing member 651 having the thickness of H3 as illustrated in FIGS. 7E and 7F, when the thickness of the booklet is within T4 to T5. Thus, the squaring process is performed. Specifically, the squaring process is performed in such a manner that the pressing member having the thickness closest to the gap between the pair of holding members is selected among the pressing members that can enter the gap between the pair of holding members of the upper and lower holding plates, according to the thickness of the booklet. In this way, the squaring process is performed in such a manner that the pressing member capable of entering the gap between the upper and lower holding plates 631 and 633 and having the thickness closest to the gap between the pair of holding members is selected among the plural pressing members, whereby a smooth surface having an appropriate width according to the thickness of the booklet is formed. Thus, the spine of the booklet can be highly-attractively deformed without forming a press-contact mark on the spine of the booklet.

When the thickness of the booklet is within T2 to T3, the squaring process is performed to the spine of the booklet S2 by the first pressing member 650 having the thickness H2 smaller than the thickness of the booklet S2 as illustrated in FIG. 7C. In this case, the first pressing member 650 comes into contact with the spine of the booklet S2 at the position where it is in contact with the upper holding plate 633, whereby the first pressing member 650 moves in the direction along the spine of the booklet S2 along the upper holding plate 633 to perform the squaring process to the upper side of the booklet in the thickness direction. Then, as illustrated in FIG. 7D, the first pressing member 650 comes into contact with the spine of the booklet S2 at the position where it is in contact with the lower holding plate 631, whereby the first pressing member 650 moves in the direction along the spine of the booklet S2 along the lower holding plate 631 to perform the squaring process to the lower side of the booklet in the thickness direction. Thus, the whole spine of the booklet S2 is squared between the holding surfaces of the holding plates 631 and 633 by the first pressing member 650 having the thickness H2 smaller than the thickness of the booklet S2.

When the thickness of the booklet is within T4 to T5, the squaring process is performed to the spine of the booklet S3 by the second pressing member 651 having the thickness H3 smaller than the thickness of the booklet S3 as illustrated in FIG. 7E. In this case, the second pressing member 651 comes into contact with the spine of the booklet S3 at the position where it is in contact with the upper holding plate 633, whereby the second pressing member 651 moves in the direction along the spine of the booklet S3 along the upper holding plate 633 to perform the squaring process to the upper side of the booklet in the thickness direction. Then, as illustrated in FIG. 7F, the second pressing member 651 comes into contact with the spine of the booklet S3 at the position where it is in contact with the lower holding plate 631, whereby the second pressing member 651 moves in the direction along the spine of the booklet S3 along the lower holding plate 631 to perform the squaring process to the lower side of the booklet in the thickness direction. Thus, the whole spine of the booklet S3 is squared between the holding surfaces of the holding plates 631 and 633 by the second pressing member 651 having the thickness H3 smaller than the thickness of the booklet S3.

Since the first pressing member 650 and the second pressing member 651 are supported by the spring 683 so as to be capable of being equalized as described above, they can move along the upper holding plate 633 and the lower holding plate 631. Since either one of the pressing members 650 and 651 enters the gap between the holding surfaces of the holding plates 631 and 633 to perform the squaring process to the spine of the booklet, the opposing holding surfaces of the holding plates 631 and 633 and the pressing members 650 and 651 can enclose the spine of the booklet to press the same. Therefore, there is no possibility that the spine of the booklet spreads to the outside of the booklet to become greater than the thickness of the booklet, with the result that a good-looking corner can be formed. Spines of booklets having any thickness can be crushed as being enclosed by the pressing member and the holding surfaces of the holding plates, resulting in that a good-looking corner can be formed even at the corner of the booklet. The order of the squaring process to the spine of the booklet may be changed. Specifically, the lower side of the booklet in the thickness direction may be processed first, and then, the upper side thereof may be processed.

The diameter D1 of each of the stopper members 649*a* and 649*b*, the diameter D2 of the first pressing member 650, and the diameter D3 of the second pressing member 651 have the relationship of D1<D2<D3. The process area (pressing amount) P2 is represented by the equation of P2=(D2−D1)/2, when the first pressing member 650, which is used to perform the deforming (squaring) process to a relatively thin booklet, is employed. On the other hand, the process area (pressing amount) P3 is represented by the equation of P3=(D3−D1)/2, when the second pressing member 651, which is used to perform the deforming (squaring) process to a relatively thick booklet, is employed. Specifically, the inequality of (P2<P3) is set in order that the deformed area (pressing amount) of the thick booklet is greater than that of the thin booklet. In the present embodiment, the deformed area (pressing amount) to which the (squaring) process is performed is set not by the positioned location by the stopper member but by the diameter of the pressing member. The diameter and the deformed area (pressing amount) of the pressing member correspond to the entering amount of the pressing member to the gap between the upper and lower holding plates 631 and 633. Since the thin booklet and the thick booklet are positioned by the same stopper members 649*a* and 649*b*, the booklet can be positioned at the same location, regardless of the thickness of the booklet. In the case of the thin booklet, the pressing member used for the squaring process has a small thickness and small diameter, while in the case of the thick booklet, the pressing member used for the squaring process has a great thickness and great diameter. This is based on the following. Specifically, the positioned location is set to be the same, regardless of the thickness of the booklet, and the pressing amount of the thick booklet is set to be always greater than that of the thin booklet, whereby the excessive deformation of the spine of the thin booklet and the insufficient deformation of the spine of the thick booklet can be prevented. Therefore, the shape of the booklet, which is subject to the squaring process, is stabilized.

In the above description, the thickness of the booklet is classified into two cases, and two types of pressing members, each having a different thickness and a different diameter, are used. However, the invention is not limited thereto. For example, the thickness of the booklet may be classified into three, four, or more, and the types of the pressing members to be used may be increased.

In the present embodiment, the holding surfaces of the upper and lower holding plates 631 and 633 at the deformation areas P2 and P3 are not in contact with the spine of the booklet before the spine of the booklet is pressed. When the spine of the booklet is pressed by the pressing member, the spine of the booklet, which is not in contact with the holding surfaces of the upper and lower holding plates 631 and 633, starts to be deformed. However, the gap between the holding surfaces, i.e., the deformation exceeding the thickness of the booklet held by the upper and lower holding plates 631 and 633, is restricted by the holding surfaces of the upper and lower holding plates 631 and 633. In this case, the holding surfaces of the upper and lower holding plates 631 and 633 at the deformation areas P2 and P3 serve as restricting surfaces for restricting the deformation of the spine in the thickness direction of the booklet. As described above, the deforming process is performed within the gap between the holding surfaces, whereby deformation of the spine in the thickness direction is restricted, and hence, a stacking property is enhanced.

In the present embodiment, the holding surfaces of the upper and lower holding plates 631 and 633 are set as smooth surfaces continuous with the holding surfaces of the upper and lower holding plates 631 and 633 that are parallel to each other. However, they do not have to be parallel to each other, so long as they can restrict the deformation exceeding the thickness of the booklet. The holding surfaces do not need to be continuous with the holding surfaces of the upper and lower holding plates 631 and 633. They may be provided with the use of another member.

Figure 8B:
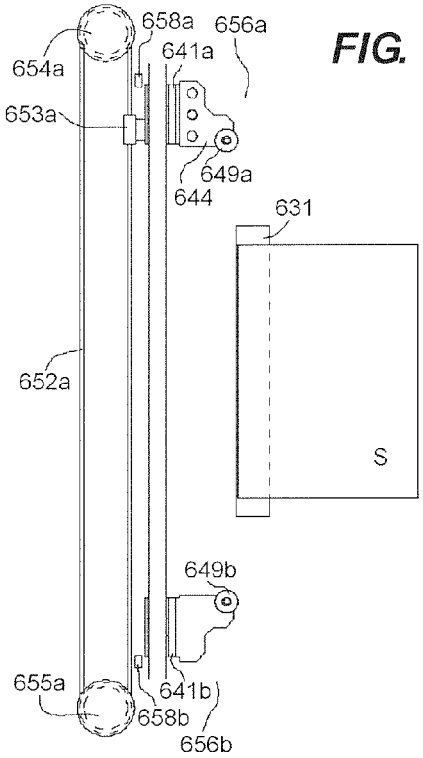
FIGS. 8A to 8D are top views illustrating an operation of the squaring unit.
Figure 8A:
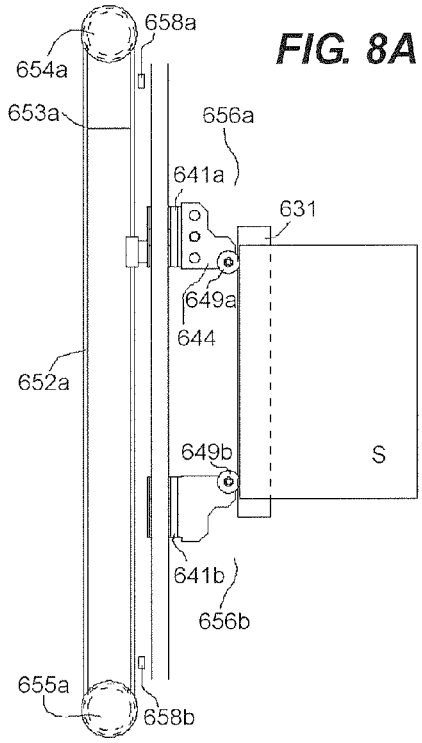

The stopper members 649*a* and 649*b*, the first pressing member 650, and the second pressing member 651 can make a reciprocating movement in the direction of A in FIG. 5 by the sliding movement of the moving units 656*a* and 656*b* between the holding surfaces of the upper and lower holding plates 631 and 633 of the holding unit 630. When the moving unit 656*a* is at the position outside the portion between the holding surfaces of the upper and lower holding plates 631 and 633 (when the moving unit 656*a* is located at the side of the upper and lower holding plates 631 and 633), the changeover unit 657 is slid. Thus, the member located between the holding surfaces of the upper and lower holding plates 631 and 633 can be changed. When the booklet conveyed from the conveying portion 620 is positioned by the holding unit 630, either one of the stopper members 649*a* and 649*b* enter the gap between the holding surfaces of the upper and lower holding plates 631 and 633, and are located at the inside from the width of the booklet (FIG. 8A). With this, the spine of the booklet is hit and positioned at the predetermined location without protruding toward the downstream side from the portion between the holding surfaces of the upper and lower holding plates 631 and 633.

In the present embodiment, the spine is positioned at the location where the spine does not protrude from the end portion of the upper and lower holding plates 631 and 633. However, the present invention is not limited thereto. The effect of the present invention is obtained, if the deforming process is performed, while restricting the deformation of the spine in the thickness direction of the booklet by the restricting surfaces of the upper and lower holding plates 631 and 633 in order to prevent the deformed spine from projecting from the end portion of the upper and lower holding plates 631 and 633. Specifically, the spine before the deforming process may be positioned at the location where the spine protrudes from the end portion of the upper and lower holding plates 631 and 633.

Figure 3:
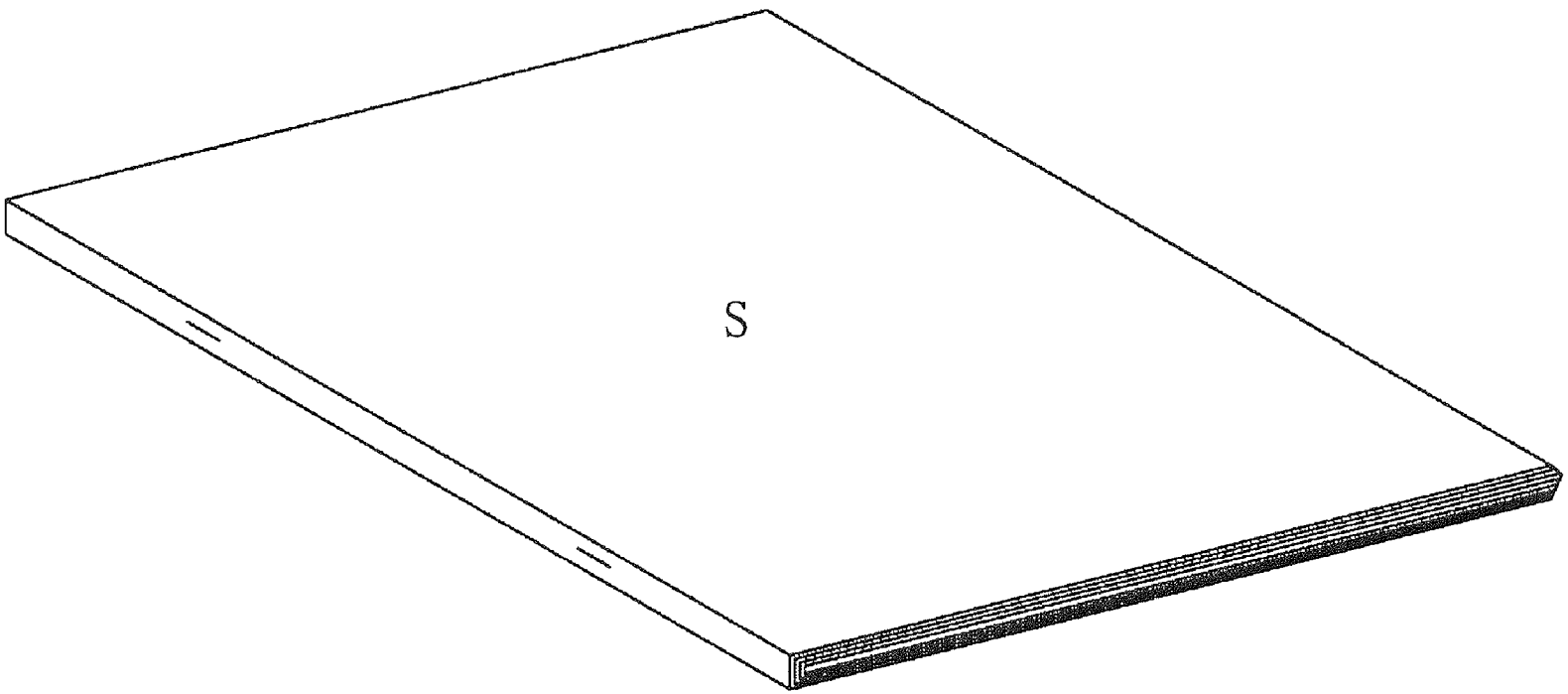
FIG. 3 is a perspective view illustrating a booklet before a squaring process and a booklet after the squaring process.
Figure 8D:
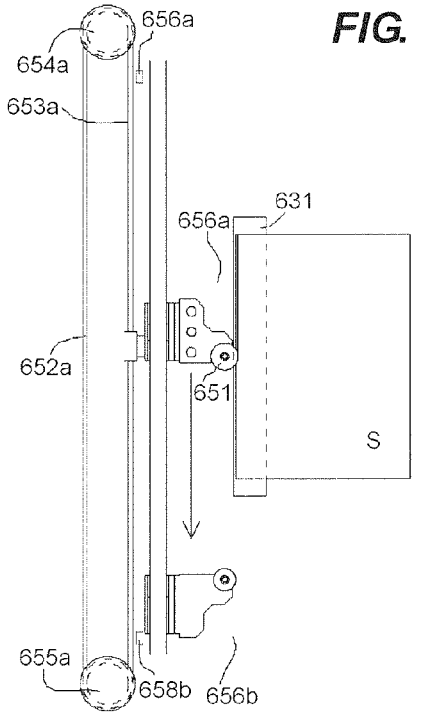
Figure 8C:
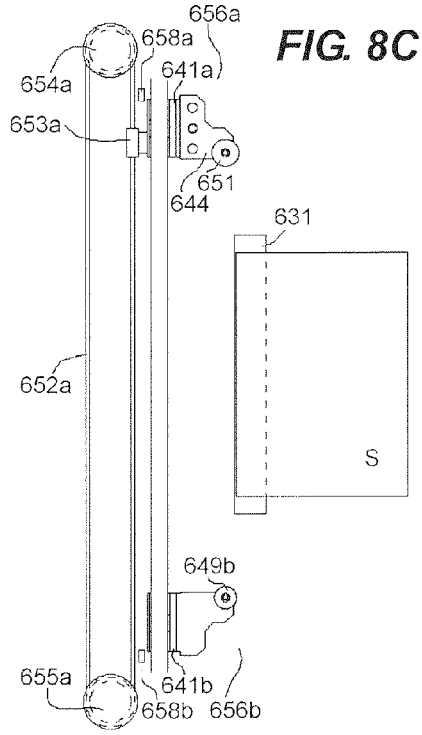
Figure 9B:
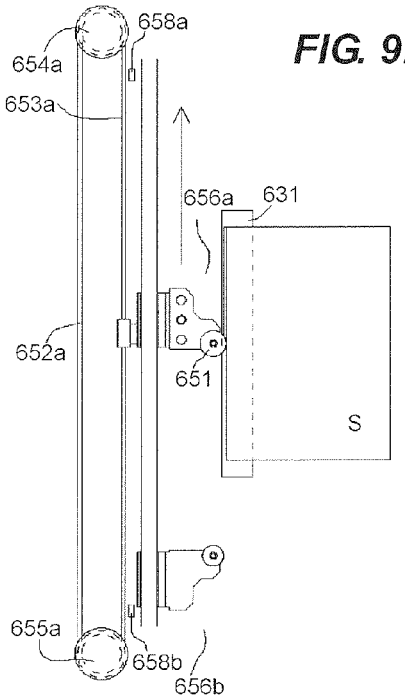
FIGS. 9A to 9D are top views illustrating an operation of the squaring unit.
Figure 9A:
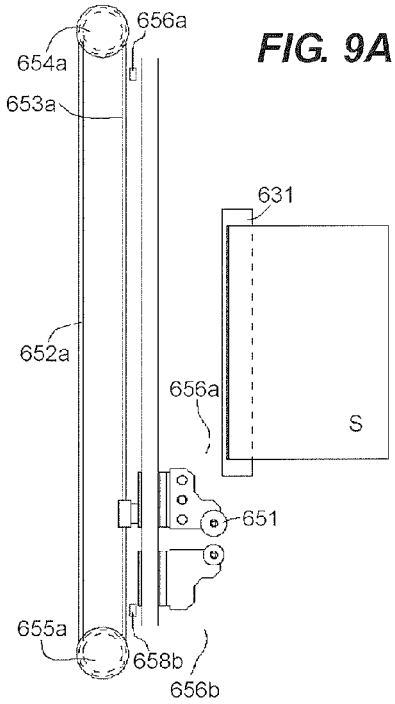
Figure 9D:
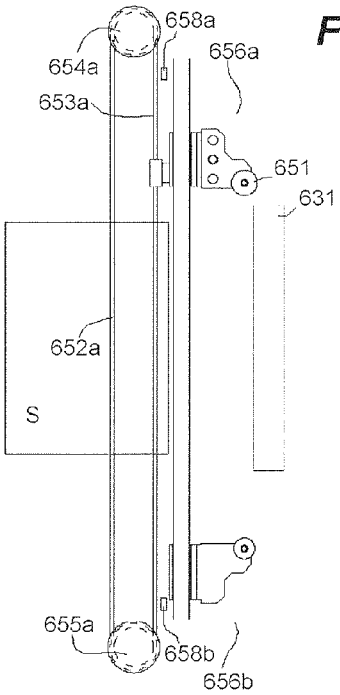
Figure 9C:
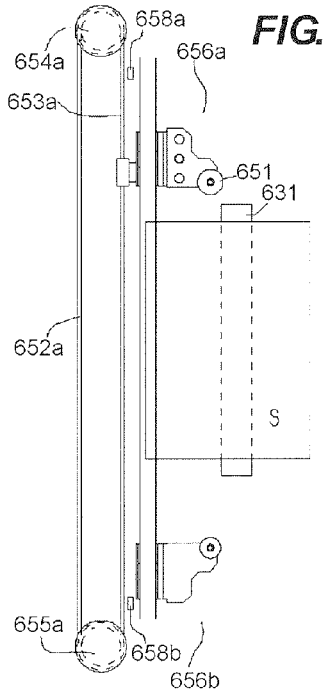

The booklet conveyed to the stopper members 649*a* and 649*b* is detected by the positioning detection sensor 626 (see FIG. 4). As described above, the thickness of each of the stopper members 649*a* and 649*b* is set to be greater than the thickness of the booklet in order that the spine of the thick booklet can be positioned through the abutment against the stopper members. Therefore, when the stopper members 649*a* and 649*b* are located between the upper and lower holding plates 631 and 633, the upper holding plate 633 cannot hold the booklet. Accordingly, as illustrated in FIG. 8B, after the stopper members 649*a* and 649*b* are moved to the side of the upper and lower holding plates 631 and 633 after the booklet is positioned, the vicinity of the spine of the booklet is nipped and held by the holding unit 630. In this case, the spine of the booklet does not protrude from the end face of the upper and lower holding plates 631 and 633 at the downstream side in the conveying direction. Since the booklet is nipped and held by the upper and lower conveying belts 621 and 622 of the conveying portion 620, the booklet is prevented from being shifted. Thereafter, the stopper member 649*a* is changed to the first pressing member 650 or the second pressing member 651 by the changeover unit 657 according to the thickness of the booklet detected by the thickness detection sensor 681, as illustrated in FIG. 8C. FIG. 8C illustrates that the member is changed to the second pressing member 651. The moving unit 656*a* is moved from the position outside one end of the booklet to the position outside the other end of the booklet as illustrated in FIG. 8D, whereby the spine of the booklet is pressed to perform the squaring process to the upper side (or lower side as described above) of the booklet in the thickness direction. Thereafter, as illustrated in FIG. 9A, the position of the pressing member is displaced to the lower side (or upper side as described above) in the thickness direction of the booklet. As illustrated in FIGS. 9B and C, the moving unit 656*a* is moved to the position outside the other end of the booklet, whereby the spine of the booklet is pressed to perform the squaring process to the upper side (or lower side as described above) of the booklet in the thickness direction. The booklet that is subject to the squaring process is conveyed to the downstream side as illustrated in FIG. 9D. FIG. 3 illustrates the booklet having the squared spine.

As illustrated in FIG. 4, in the squaring processing portion 600, the conveying portion 660 includes the lower conveying belt 661 and the upper conveying belt 662 that receive the booklet, which has been subject to the squaring process and which is released from the holding unit 630 that nips and holds the booklet, and conveys the same to the downstream side. The upper conveying belt 662 can pivot about a supporting point 663 according to a thickness of the booklet. The upper conveying belt 662 is pressed against the lower conveying belt 661 by a spring (not illustrated). The upper and lower conveying belts 661 and 662 are coupled to the conveying portion 620 through the drive-connection, and are driven by the motor SM4.

The conveyer tray 670 has stacked thereon the booklets discharged from the conveying portion 660. A conveyer belt 671 that receives a drive of a motor SM10 to move in the conveying direction is mounted on the lower surface of the conveyer tray 670. The conveyer belt 671 repeats the movement in a predetermined amount every time the booklet is discharged, thereby stacking the booklets. The discharge detection sensor 664 detects the discharge of the booklet from the conveying portion 660.

(Controlling Portion)

Figure 10:
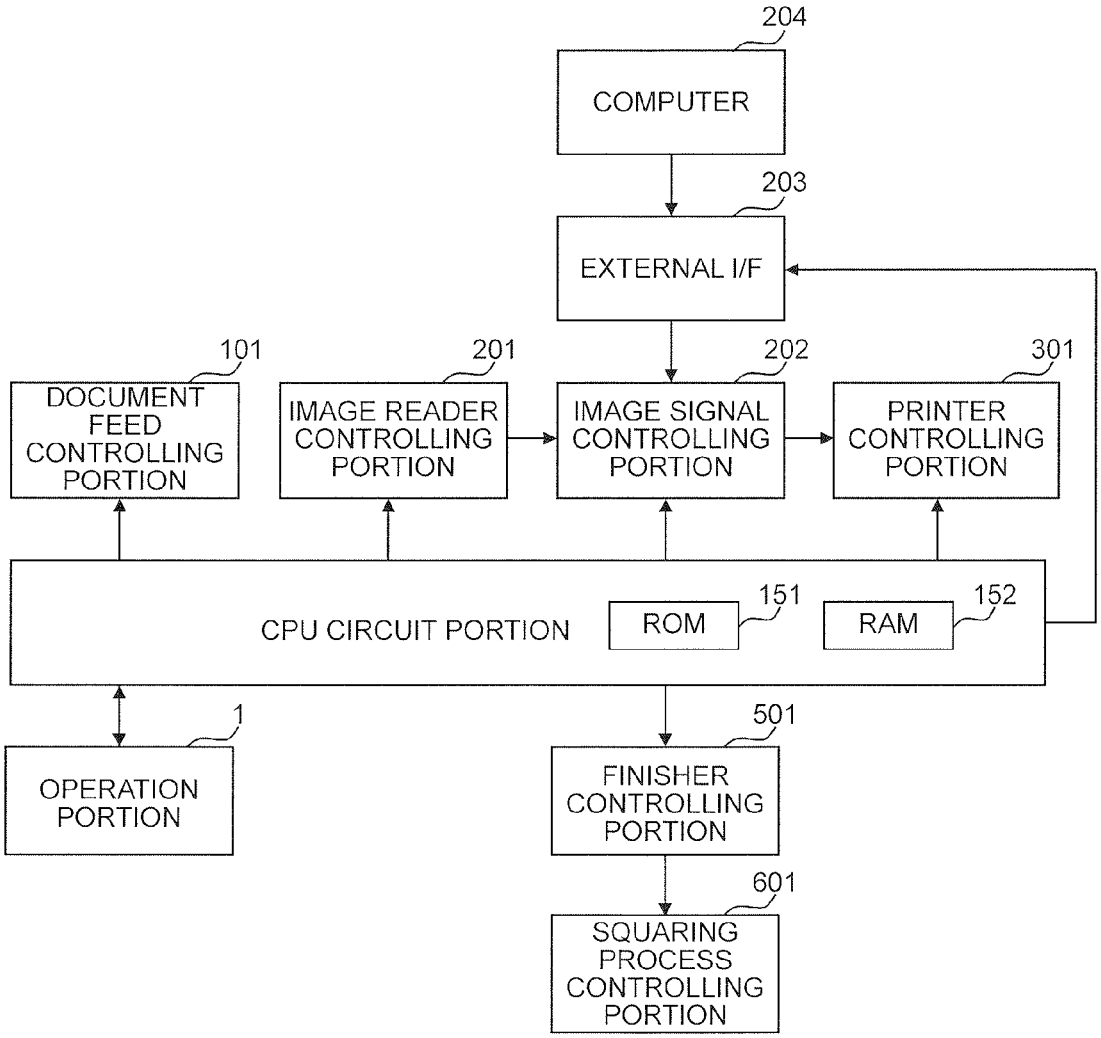
FIG. 10 is a block diagram illustrating a control system of an image forming system.

A control system of the image forming system will be described here with reference to FIG. 10. FIG. 10 is a block diagram illustrating the control system of the image forming system 1000. A CPU circuit portion 150 has a CPU (not illustrated), a ROM 151, and a RAM 152. The controlling portion controls the document feed controlling portion 101, the image reader controlling portion 201, the image signal controlling portion 202, the printer controlling portion 301, the finisher controlling portion 501, and the external I/F 203 according to the control program stored in the ROM 151 and the setting by the operation portion 1. The document feed controlling portion 101 controls the document feed portion 100, the image reader controlling portion 201 controls the image reader 200, and the printer controlling portion 301 controls the printer 300. The finisher controlling portion 501 controls the finisher 500 and the saddle stitch binding portion 800, and the squaring processing portion 601 controls the squaring processing portion 600 based on the instruction from the finisher controlling portion 501.

The operation portion 1 has plural keys for setting various functions relating to the image formation, and a display portion for displaying the set state. The operation portion 1 outputs a key signal corresponding to the operation of each key by a user to the CPU circuit portion 150, and displays the corresponding information to the display portion based on the signal from the CPU circuit portion 150.

The RAM 152 is used as an area for temporarily retaining the control data or as a working area for computation involved with the control. The external I/F (external interface) 203 is an interface between the image forming system 1000 and an external computer 204. It expands the print data from the computer 204 into a bit-mapped image, and outputs the resultant to the image signal controlling portion 202 as image data. The image reader controlling portion 201 outputs the image of the document read by the image sensor 109 to the image signal controlling portion 202. The printer controlling portion 301 outputs the image data from the image signal controlling portion 202 to the exposure controlling portion 110.

Figure 11:
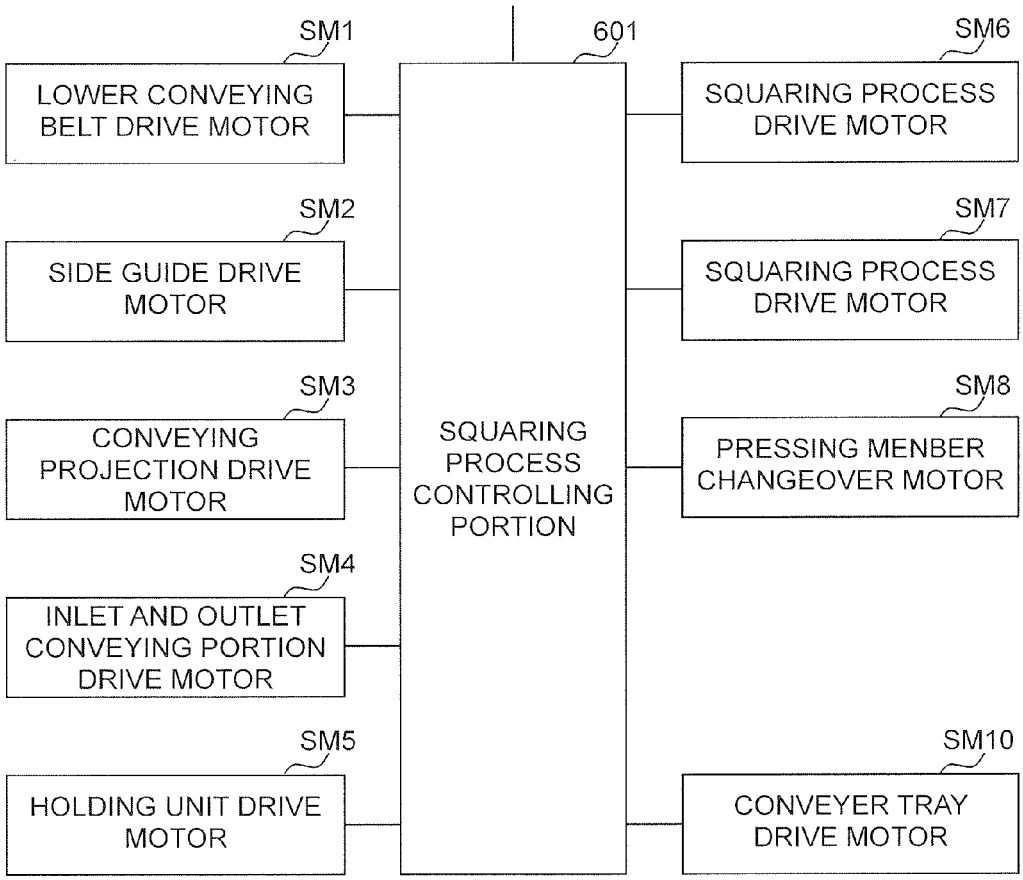
FIG. 11 is a block diagram illustrating a control system of the squaring unit.

FIG. 11 is a block diagram of the squaring process controlling portion 601. The squaring process controlling portion 601 controls the respective drive motors SM1, SM2, SM3, SM4, SM5, SM6, SM7, SM8, and SM10.

(Operation of Squaring Process)

The operation of the squaring process at the squaring processing portion 600 will be described based on the configuration described above. The operations of the respective portions will be described together with the movement of the booklet.

When a saddle-stitching mode is selected by the operation portion 1, it can be selected whether the squaring process mode is set or not.

When the squaring process mode is not selected, the saddle-stitched booklet created at the saddle stitch binding portion 800 is discharged onto the conveyer tray 670 by the lower conveying belt 611, the conveying projection 613, the conveying portion 620, and the outlet conveying portion 660. In this case, the pair of side guides 612, the upper holding plate 633, and moving units 656*a* and 656*b* are retracted at the position where they do not block the conveying path.

Figure 12:
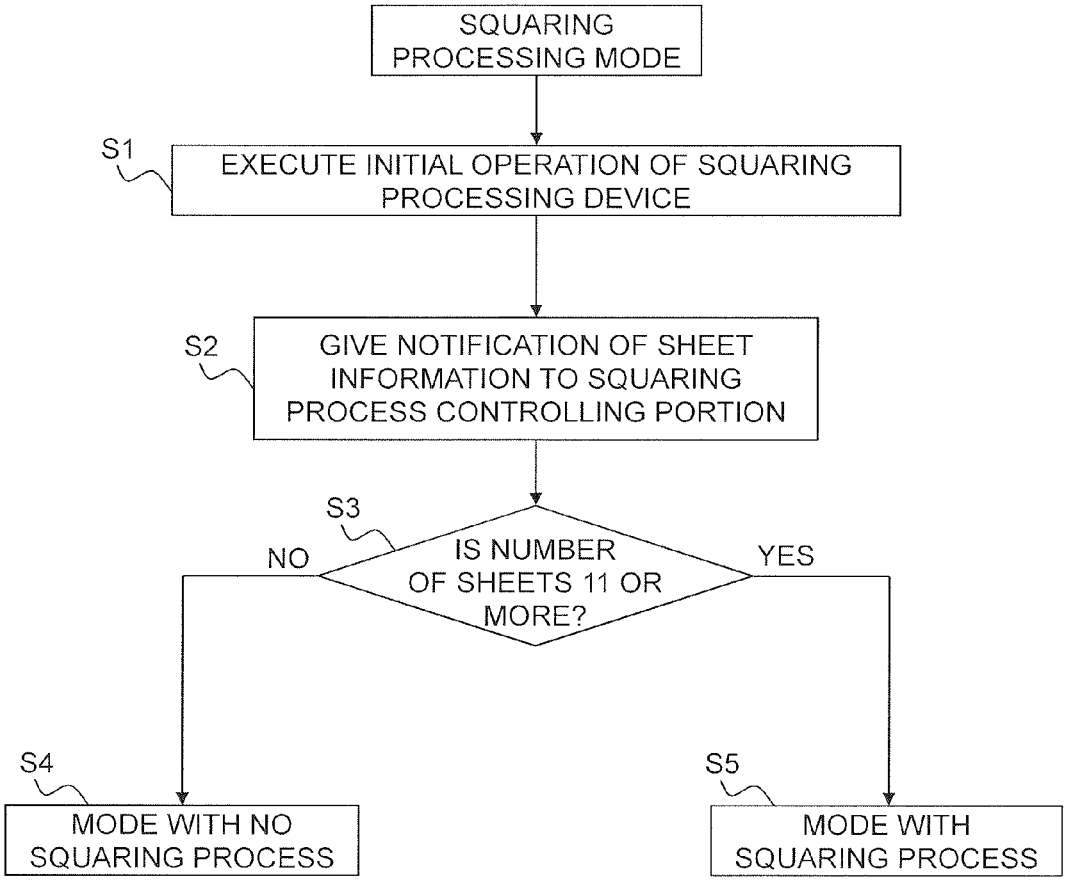
FIG. 12 is a flowchart illustrating a flow of an operation of a squaring process mode.
Figure 13:
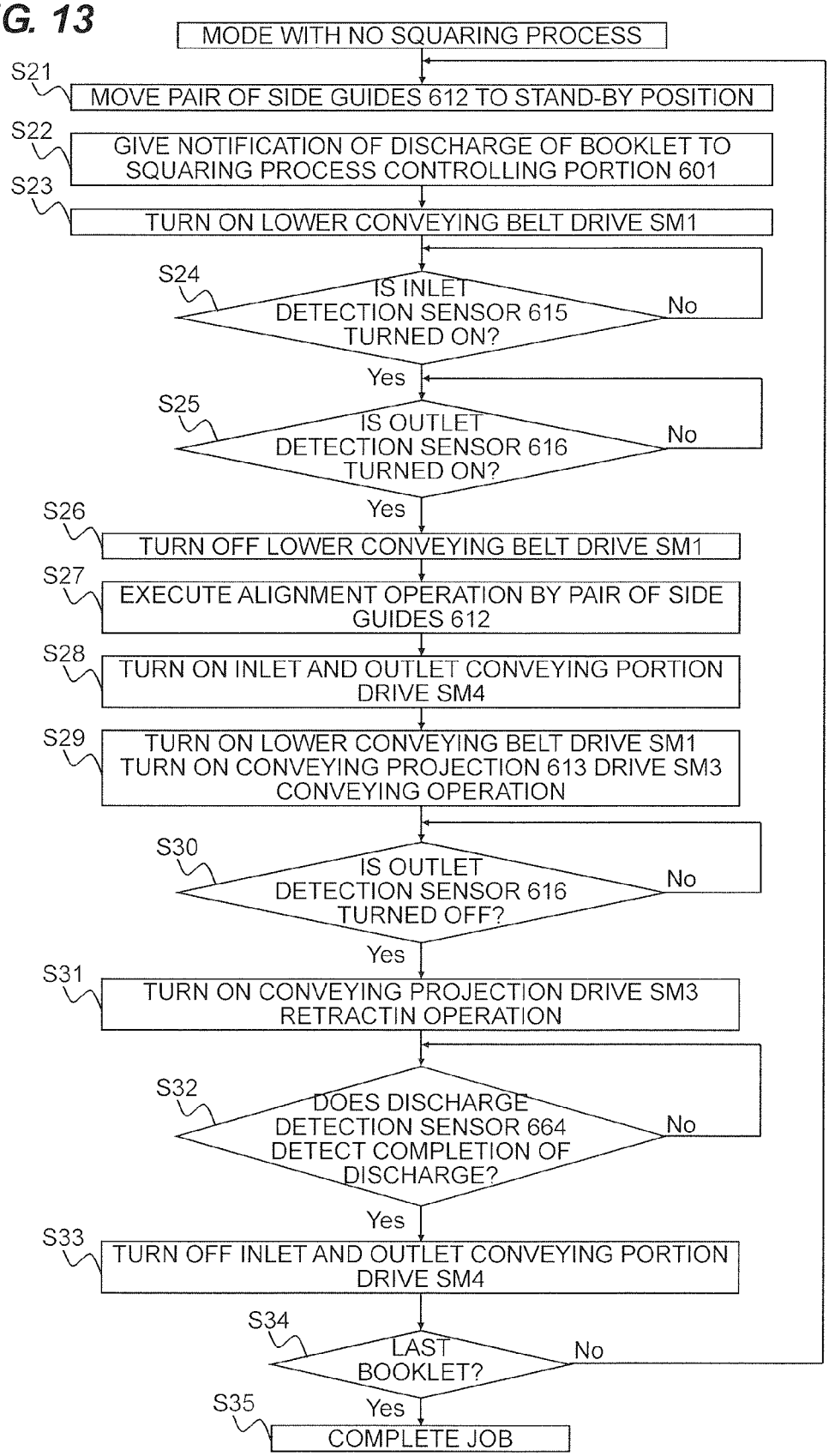
FIG. 13 is a flowchart illustrating a flow of an operation of a mode with no squaring process.
Figure 14:
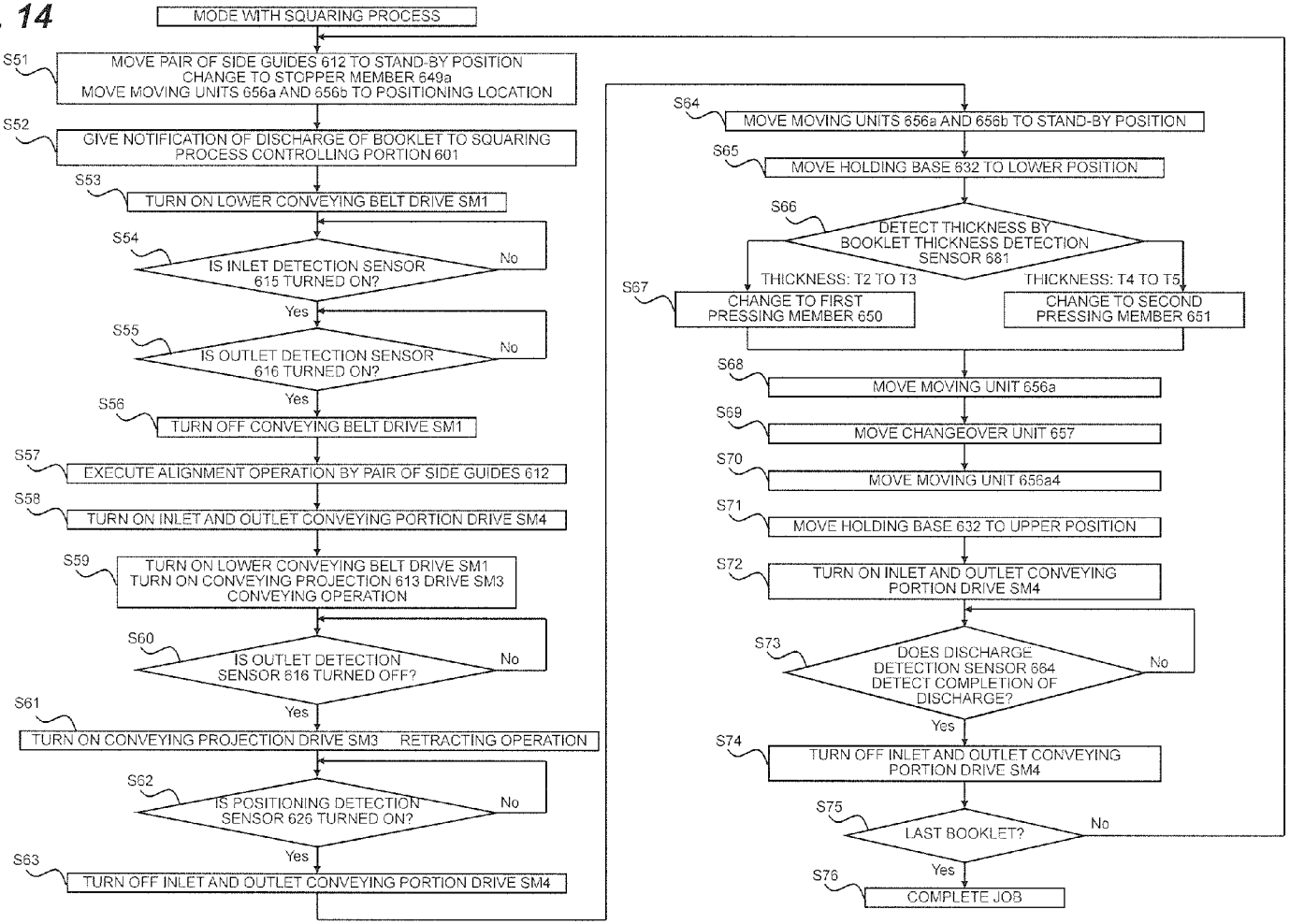
FIG. 14 is a flowchart illustrating a flow of an operation of a mode with a squaring process.

The operation when the squaring process mode is selected will be described below in detail. FIGS. 12, 13, and 14 are flowcharts illustrating the flow of the operation when the squaring process mode is selected.

When the squaring process mode is selected, the squaring processing portion 600 performs an initial operation (S1) as illustrated in FIG. 12. When the booklet is made at the saddle stitch binding portion 800, the number of sheets of the booklet, the size of the sheet, and the number of booklets to be formed are reported to the squaring process controlling portion 601 (S2) before the booklet is discharged to the receiving portion 610 of the squaring processing portion 600 by the pair of second fold conveying rollers 812. The squaring process controlling portion 601 determines whether the number of sheets of the booklet S is 11 or more (S3). When the reported number of sheets of the booklet is 10 or less (NO), the squaring process controlling portion 601 selects the mode with no squaring process (S4), while when it is 11 or more (YES), the squaring process controlling portion 601 selects the mode with the squaring process (S5).

When the number of the sheets of the booklet is 10 or less, and the mode with no squaring process is selected, the flow in FIG. 13 is performed.

The pair of side guides 612 arranged at both sides of the conveying path of the receiving portion 610 moves at the stand-by position according to the size of the booklet (S21). When receiving the notification of the discharge from the saddle stitch binding portion 800 (S22), the lower conveying belt 611 is rotated by the drive motor SM1 (S23) to convey the booklet. After the inlet detection sensor 615 and the outlet detection sensor 616 detect the booklet (S24, S25), the conveyance of the booklet is temporarily stopped (S26). Thereafter, the pair of side guides 612 performs an alignment operation by the drive motor SM12 (S27). Then, the drive motor SM4 drives the conveying portion 620 and the conveying portion 660 (S28), whereby the conveyance of the booklet is restarted by the conveying projection 613 and the lower conveying belt 611 arranged at the upstream side of the receiving portion 610 (S29). The conveying projection 613 is driven by the drive motor SM13. When the outlet detection sensor 616 detects the discharge of the booklet (S30), the conveying projection 613 is retracted toward the upstream side in the conveying direction (S31). When the booklet conveyed by the conveying portion 620 and the conveying portion 660 is discharged to the conveyer tray 670 and the discharge detection sensor 664 detects the discharge (S32), the conveying portion 620 and the conveying portion 660 stop (S33). The booklet discharged onto the conveyer tray 670 is stacked one by one in an imbricated state. When the discharged booklet is not the last one, the processing returns to S21, and when the discharged booklet is the last one, the job is completed (S34, S35).

On the other hand, when the number of the sheets of the booklet is 11 or more, and the mode with the squaring process mode is selected, the flow in FIG. 14 is executed.

The pair of side guides 612 arranged at both sides of the conveying path of the receiving portion 610 moves to the stand-by position according to the size of the booklet. With this, the member is changed to the stopper member 649*a* by the changeover unit 657, whereby the moving units 656*a* and 656*b* move to the positioning location (S51). The positioning location is changed according to the size of the booklet. The positioning location is set to the position where the spine of the booklet does not rotate when it hits the stopper members 649*a* and 649*b* and the parallel state of the spine of the booklet is maintained with respect to the moving direction of the moving units 656*a* and 656*b*. When receiving the discharge notification from the saddle stitch binding portion 800 (S52), the lower conveying belt 611 is rotated by the drive motor SM1 (S53) to convey the booklet. After the inlet detection sensor 615 and the outlet detection sensor 616 detect the booklet (S54, S55), the conveyance of the booklet is temporarily stopped (S56).

Figure 15:
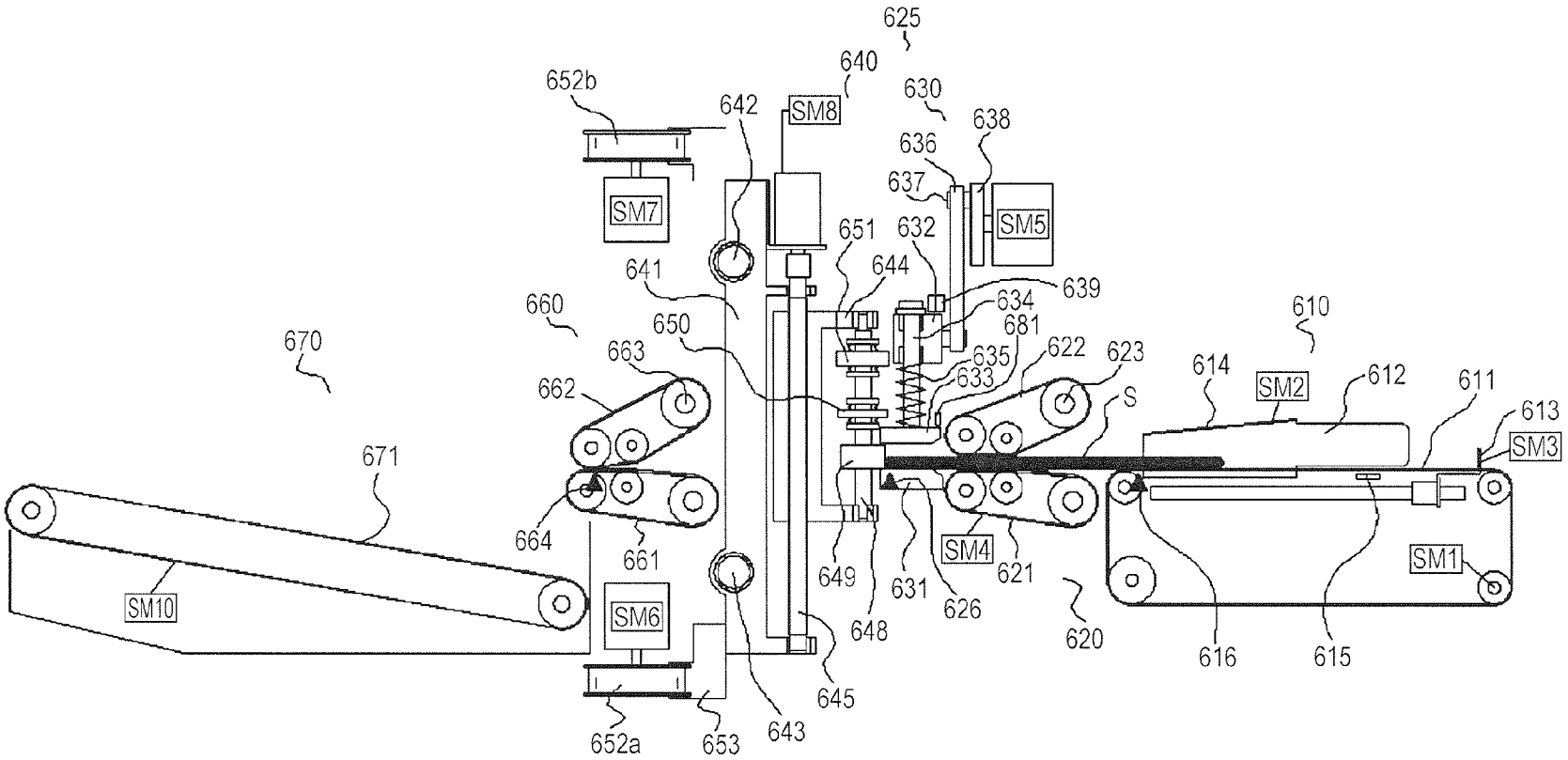
FIG. 15 is a top view illustrating an operation of the squaring unit.

Thereafter, the pair of side guides 612 performs an alignment operation by the drive motor SM12 (S57). Then, the drive motor SM4 drives the conveying portion 620 and the conveying portion 660 (S58), whereby the conveyance of the booklet is restarted by the conveying projection 613 and the lower conveying belt 611 arranged at the upstream side of the receiving portion 610 (S59). The conveying projection 613 is driven by the drive motor SM13. When the outlet detection sensor 616 detects the discharge of the booklet (S60), the conveying projection 613 is retracted toward the upstream side in the conveying direction (S61). When the booklet conveyed by the conveying portion 620 is detected by the positioning detection sensor 626 (STEP 102), the conveying portion 620 stops (S63). In this case, the booklet is positioned at the location where the spine of the booklet hits the stopper members 649*a* and 649*b*, and the spine of the booklet does not project from the lower end between the holding surfaces of the upper and lower holding plates 631 and 633 in the conveying direction, as illustrated in FIG. 15.

Then, the moving units 656*a* and 656*b* move to the stand-by position that is outside the portion between the holding surfaces of the upper and lower holding plates 631 and 633 (the position at the side of the upper and lower holding plates 631 and 633) (S64). The drive motor SM5 moves the holding base 632 to the lower position (S65), whereby the spine of the booklet is pressed and held by the opposing holding surfaces of the upper and lower holding plates 631 and 633. Next, the thickness detection sensor 681 detects the position of the upper holding plate 633, which presses and holds the booklet (S66), whereby the thickness of the booklet is measured. When the thickness of the booklet is within the above-mentioned range of T2 to T3, the pressing member is changed to the first pressing member 650, while when the thickness of the booklet is within the range of T4 to T5, the pressing member is changed to the second pressing member 651 (S67). Then, the moving unit 656*a* is moved from one side to the other side in the width direction along the spine of the booklet (S68), whereby the squaring process is performed at the upper side of the spine of the booklet in the thickness direction. The pressing position of the pressing member in the thickness direction of the booklet is changed upon the changeover of the moving direction of the pressing member along the spine of the booklet at the position outside the end of the booklet in the moving direction. Specifically, the position of the pressing member is changed by the changeover unit 657 so as to be aligned to the lower side of the spine of the booklet in the thickness direction (S69). Thereafter, the moving unit 656*a* is moved from one side to the other side in the widthwise direction along the spine of the booklet (S70), whereby the squaring process is performed at the lower side of the spine of the booklet in the thickness direction.

Figure 16:
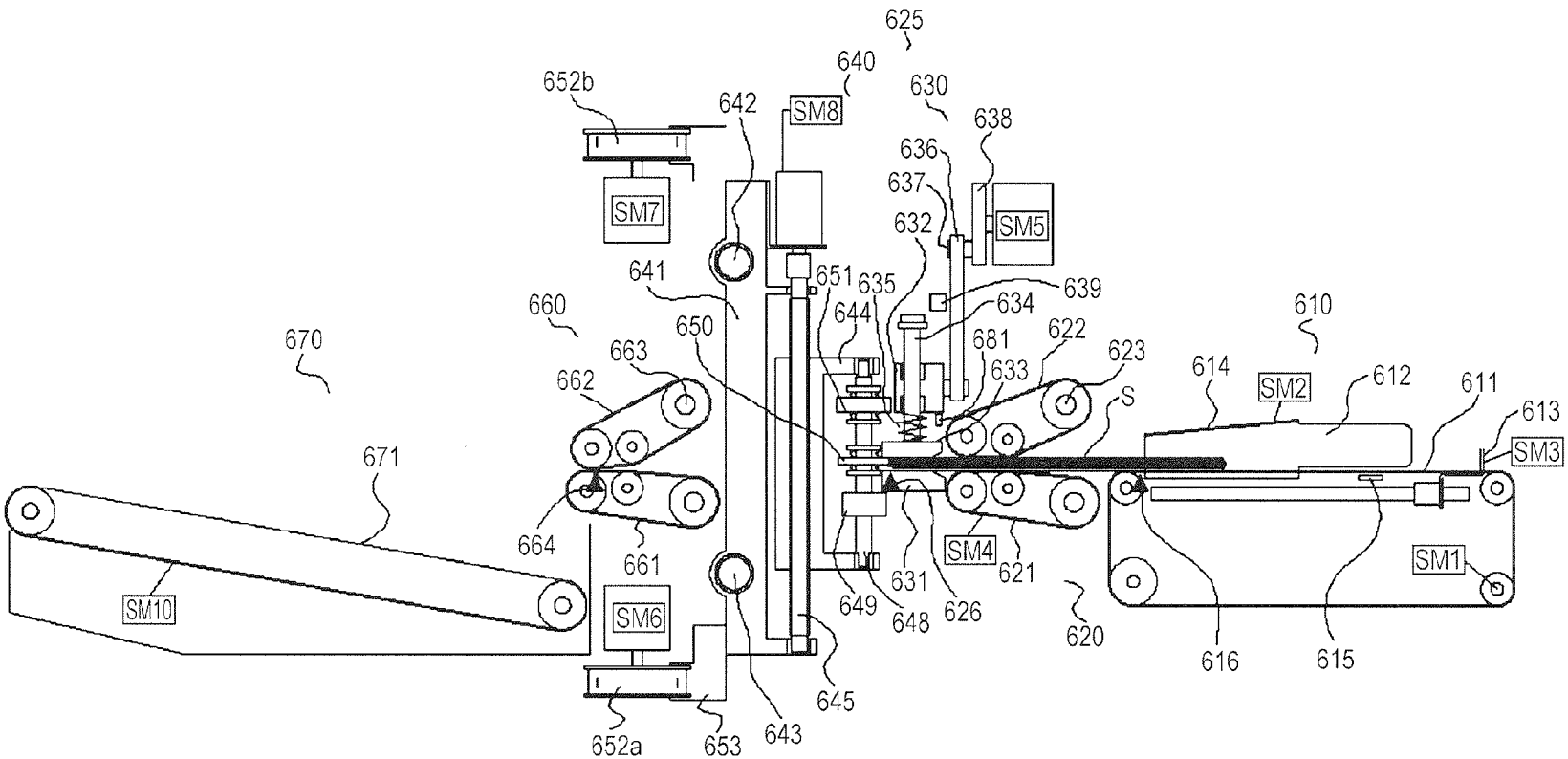
FIG. 16 is a top view illustrating an operation of the squaring unit.
Figure 17:
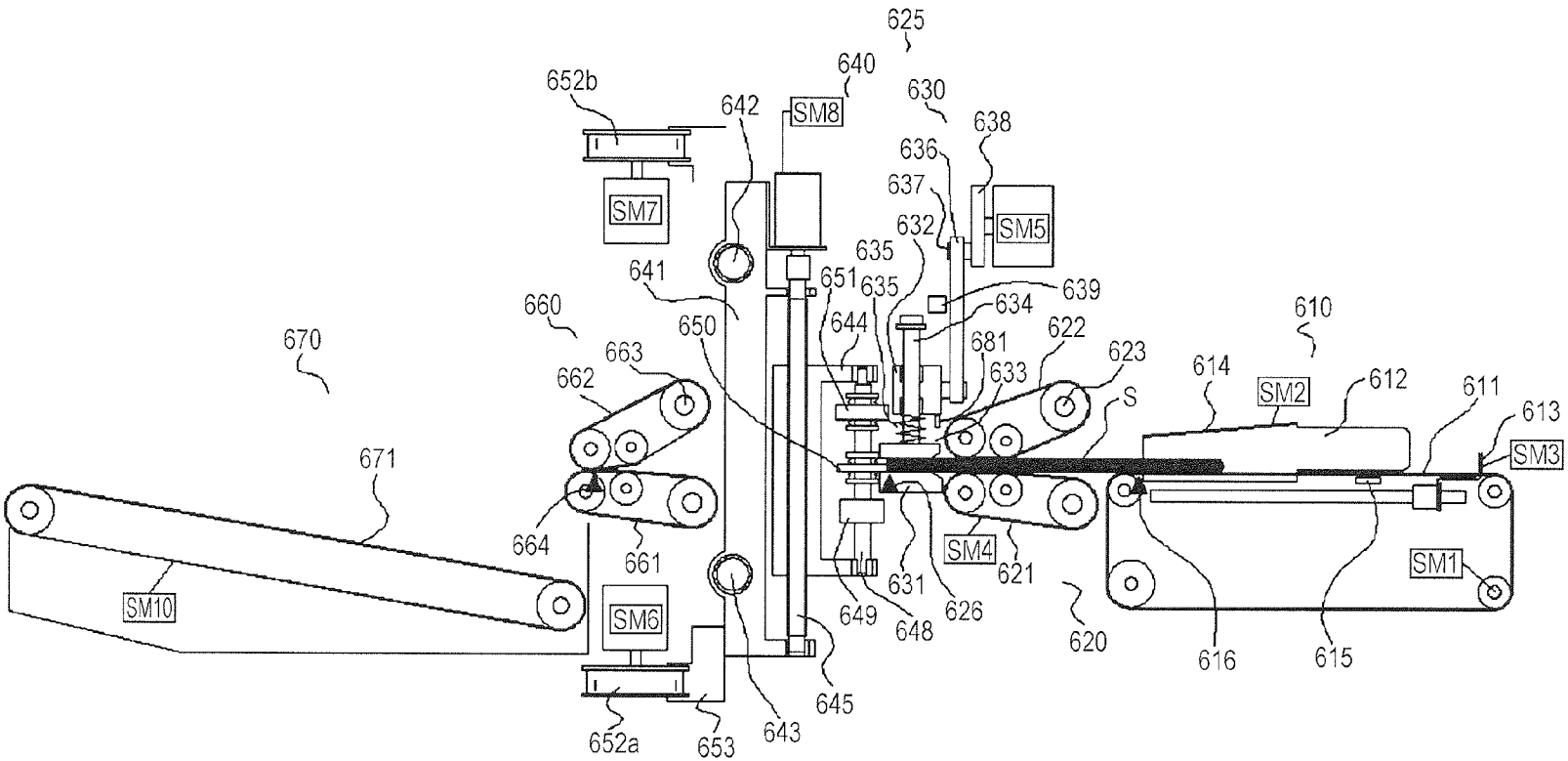
FIG. 17 is a top view illustrating an operation of the squaring unit.
Figure 18:
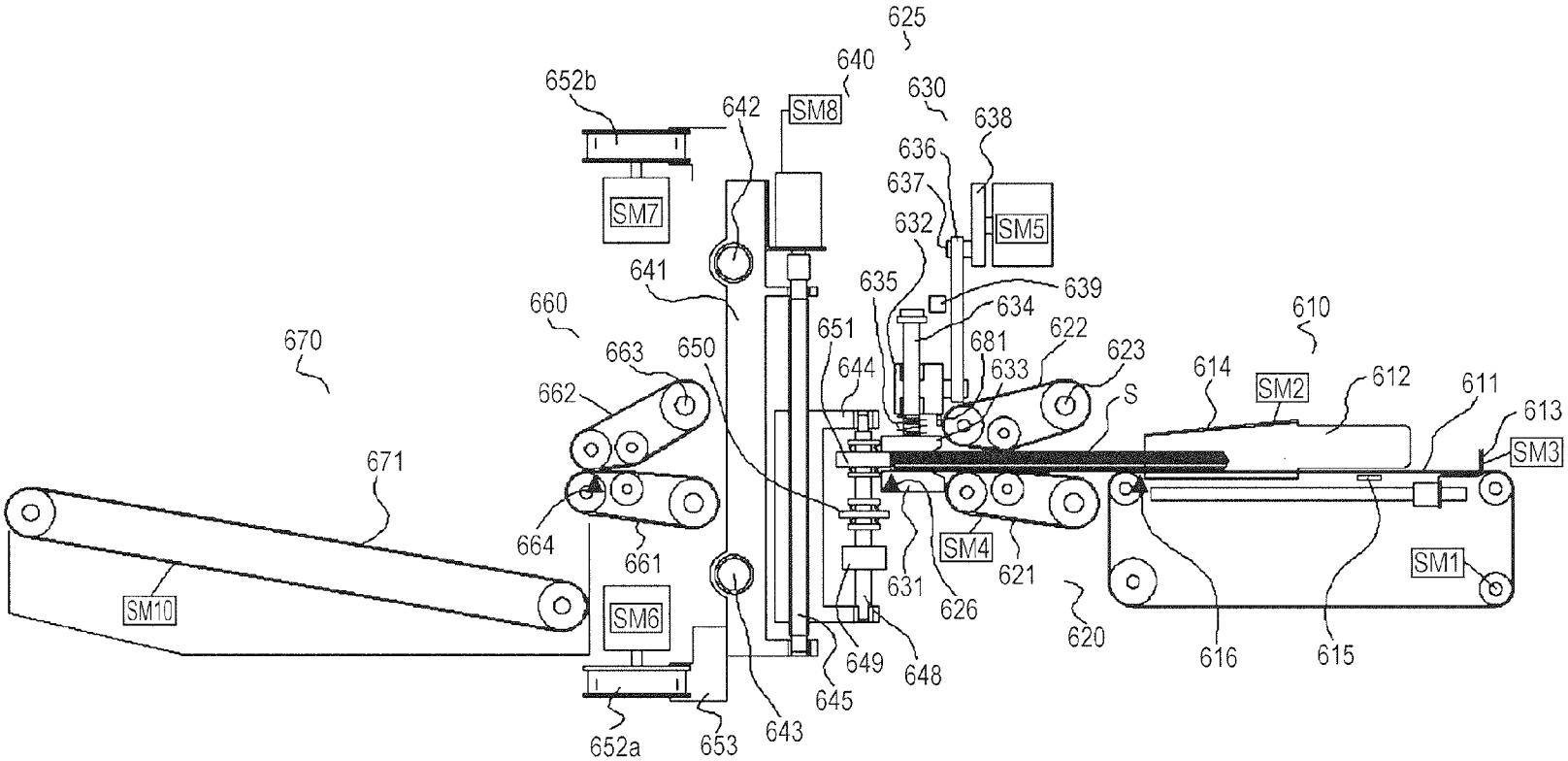
FIG. 18 is a top view illustrating an operation of the squaring unit.
Figure 19:
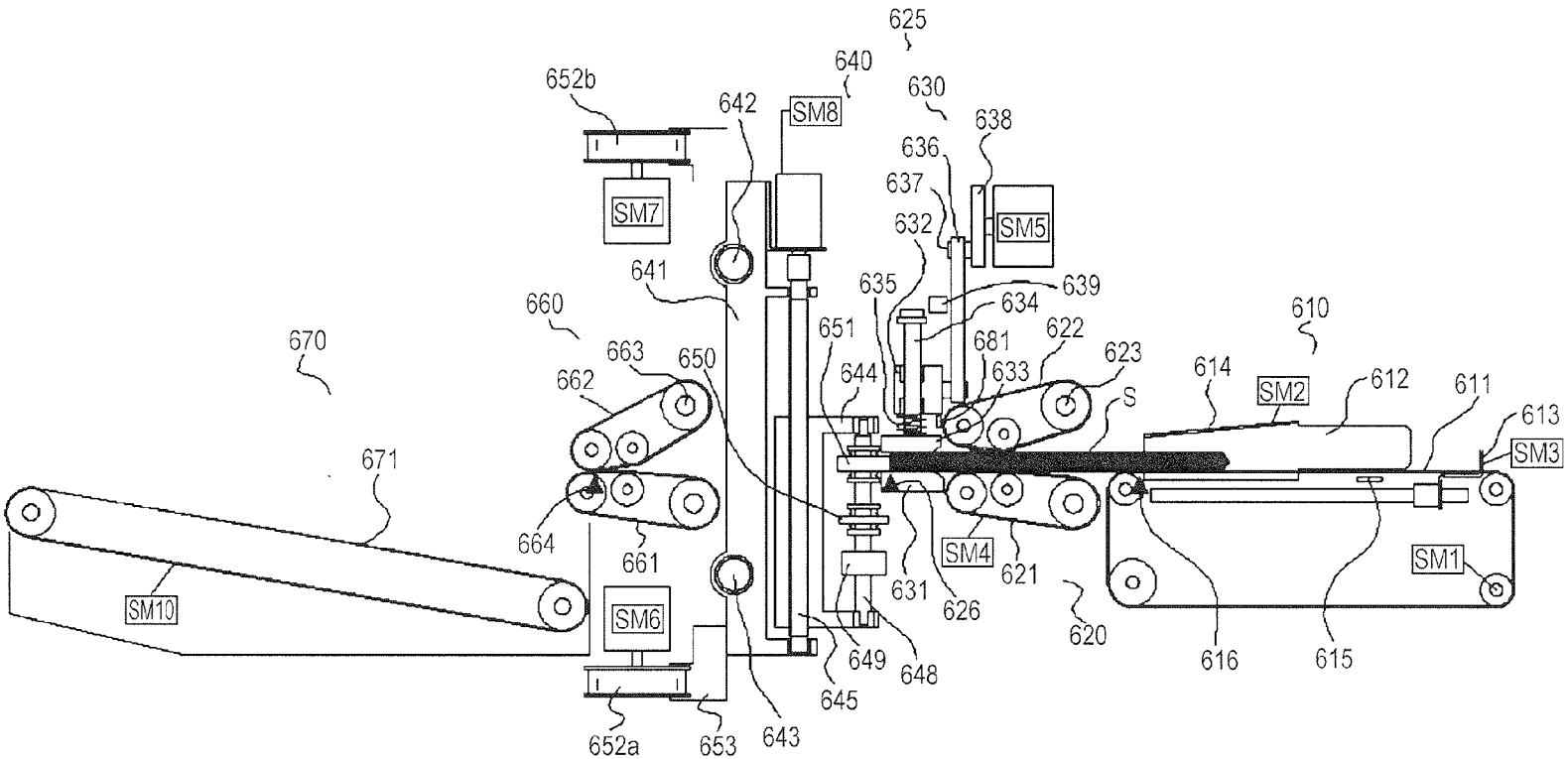
FIG. 19 is a top view illustrating an operation of the squaring unit.
Figure 20A:
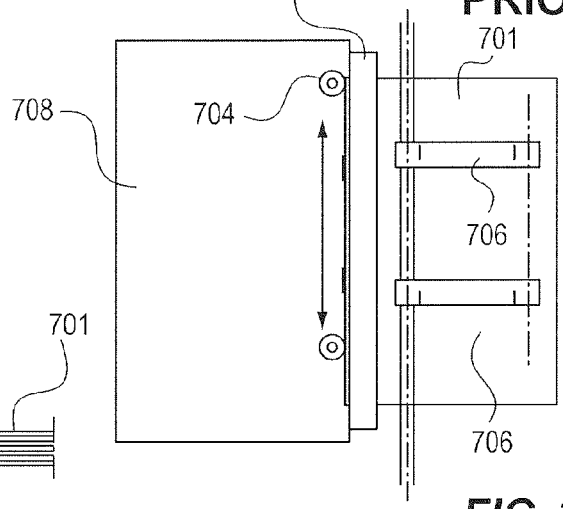
FIG. 20A PRIOR ART
FIGS. 20A to 20F are explanatory views of a conventional technique.
Figure 20E:
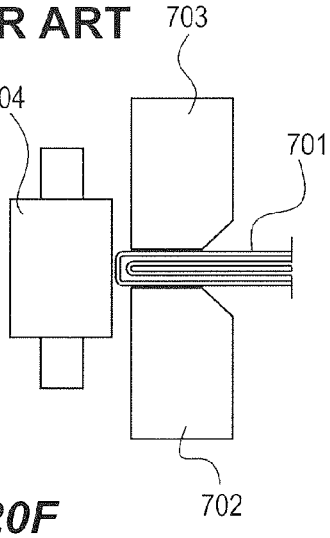
FIG. 20E PRIOR ART
Figure 20B:
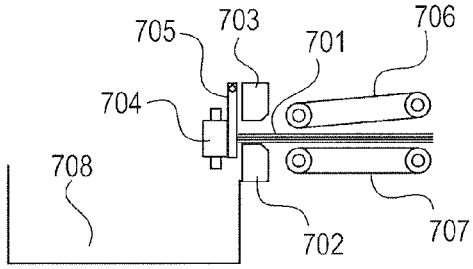
FIG. 20B PRIOR ART
Figure 20F:
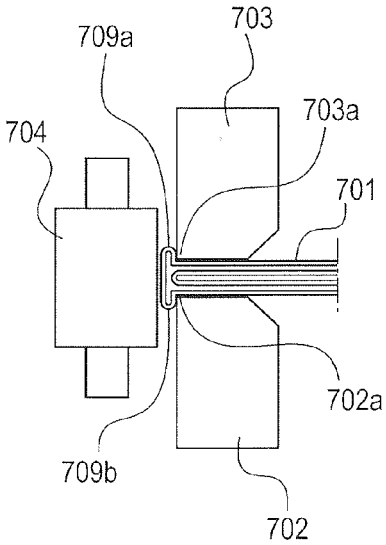
FIG. 20F PRIOR ART
Figure 20C:
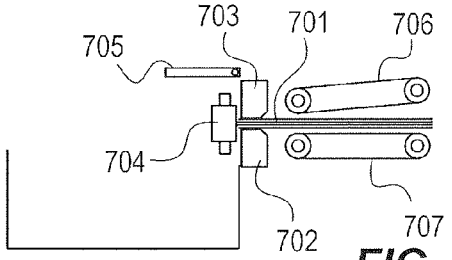
FIG. 20C PRIOR ART
Figure 20D:
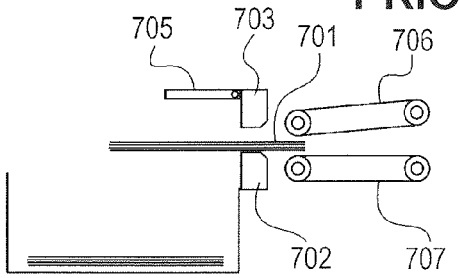
FIG. 20D PRIOR ART
Figure 21:
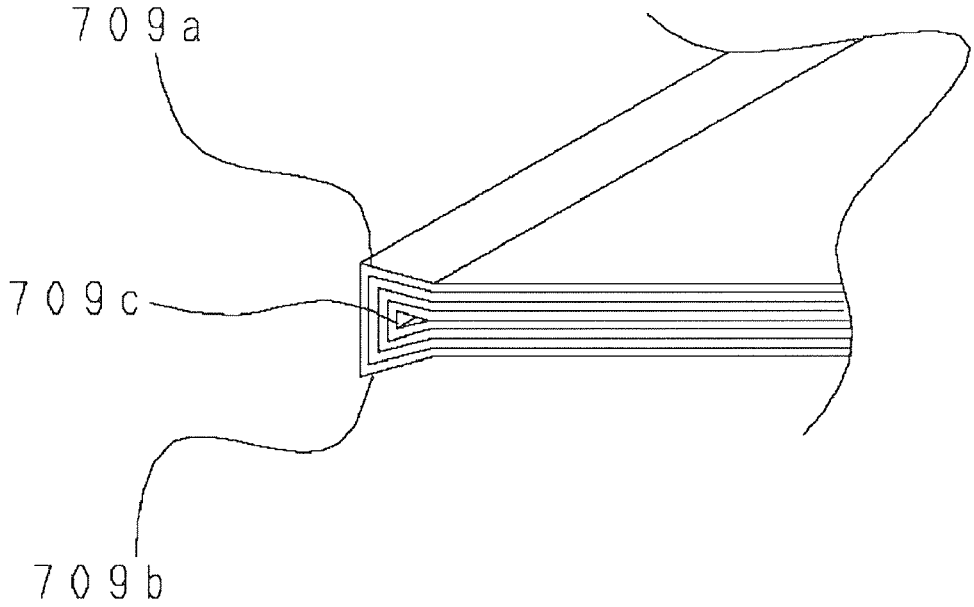
FIG. 21 PRIOR ART
FIG. 21 is an explanatory view of a conventional technique.

FIG. 16 is a view illustrating that the squaring process is performed at the upper side of the booklet S in the thickness direction by the first pressing member 650. FIG. 17 is a view illustrating that the squaring process is performed at the lower side of the booklet S in the thickness direction by the first pressing member 650. FIG. 18 is a view illustrating that the squaring process is performed at the upper side of the booklet S in the thickness direction by the second pressing member 651. FIG. 19 is a view illustrating that the squaring process is performed at the lower side of the booklet S in the thickness direction.

As described above, since the spine of the booklet is enclosed by the upper and lower holding plates 631 and 633 and the first pressing member 650 or the second pressing member 651, extra pressing force is not applied, resulting in that a smooth surface having a width substantially equal to the thickness of the booklet is formed. Accordingly, the sheet spine at the center of the booklet is not deformed. Since the spine of the booklet is enclosed, without a gap, by the holding surfaces of the upper holding plate 633 and the lower holding plate 631, and the pressing members 651 and 653, a good-looking squaring can be performed. The positioned location is made equal by the stopper members 649*a* and 649*b*, regardless of the thickness of the booklet, whereby the pressing amount of the thick booklet is set, by the thickness and the diameter of the pressing member, to be always greater than the pressing amount of the thin booklet. Therefore, crushing the spine of the thin booklet excessively (the excessive deformation) and insufficient crushing (deformation) of the spine of the thick booklet can be avoided, whereby a good-looking booklet is stably formed.

After the movement of the moving unit 656*a* is completed, the holding base 632 moves to the upper position (S71), and the upper and lower holding plates 631 and 633 are separated from each other, whereby the booklet that is pressed and held by the opposing holding surfaces is released. The drive motor SM4 drives the inlet conveying portion 620 and the outlet conveying portion 660 (S72), so that the booklet is discharged to the conveyer tray 670. When the discharge detection sensor 664 detects the discharge of the booklet (S73), the inlet conveying portion 620 and the outlet conveying portion 660 stop (S74). The booklet discharged onto the conveyer tray 670 is stacked one by one in an imbricated state. When the discharged booklet is not the last one (No), the processing returns to S51, and when the discharged booklet is the last one (Yes), the job is completed (S75, S76).

In the above-mentioned embodiment, the pressing position in the thickness direction of the booklet is changed upon the changeover of the moving direction during the reciprocating movement in such a manner that the squaring process is completed if the moving unit 656*a* makes one reciprocating movement for shortening the processing time. However, the present invention is not limited thereto. For example, after the moving unit is moved along the spine of the booklet, predetermined number of times required to deform the spine of the booklet, at the same pressing position in the thickness direction of the spine, according to the basis weight and thickness of the sheet constituting the booklet, the pressing position may be changed. Specifically, the pressing position of the pressing portion may be changed every movement in the same direction (e.g., go-return→changeover→go-return), or the pressing position of the pressing portion may be changed every predetermined number of movements (go-return-go→changeover→return-go-return). As described above, the pressing operation is executed plural times at the same pressing position in the thickness direction of the booklet, whereby a satisfactory squaring process can be performed to even a booklet including sheets that are difficult to be deformed.

The same effect can be obtained by the process in which the reciprocating movement is made in the width direction of the booklet at the same pressing position in the thickness direction of the booklet, then, the pressing position in the thickness direction of the booklet is changed, and then, the reciprocating movement is made. The pressing position in the thickness direction of the booklet may be changed after the reciprocating movement is made plural times. Since the pressing processing position in the thickness direction of the booklet is changed upon the changeover of the moving direction in the same direction, the tendency of the deformation at the spine is made uniform, whereby the good-looking squaring can be obtained.

One type of pressing member may be used, and the number of change of the pressing position may be increased according to the thickness of the booklet. In this case, the number of the pressing members can be reduced. However, as the thickness of the booklet is increased, the number of change of the pressing position is increased, so that the processing time increases.

In the above-mentioned embodiment, two cases are set according to the thickness of the booklet that is to be subject to the squaring process, and the squaring process is performed by using two types of pressing members, each having a different thickness and a different diameter. However, the present invention is not limited thereto. For example, more cases may be set, and the types of the pressing members to be used may be increased. This does not limit the present invention.

In the above-mentioned embodiment, the cases are classified by detecting the thickness of the booklet by the sensor. However, the cases are classified according to the condition that can determine the thickness of the booklet, such as the basis weight of the media (sheet), thickness, and number of sheets.

In the above-mentioned embodiment, a booklet formed by folding a single sheet in two to a booklet formed by folding 25 sheets in two are illustrated as the booklet formed by the saddle stitch binding portion 800. However, the number of sheets may be changed according to the capability of the saddle stitch binding portion 800. In the above description, the booklet that is subject to the squaring process has 11 or more folded sheets in two. However, the number of sheets of the booklet may be changed according to the basis weight or thickness of the media (sheet), and this does not limit the present invention.

In the above-mentioned embodiment, a copying machine is illustrated as the image forming apparatus. However, the present invention is not limited thereto. For example, the image forming apparatus may be other image forming apparatuses such as a printer or facsimile device, or other image forming apparatuses such as a multifunction periphery having these functions combined. When the present invention is applied to the sheet processing apparatus used in the image forming apparatus described above, the same effect can be obtained.

In the above-mentioned embodiment, the sheet processing apparatus that is detachably attachable to the image forming apparatus is illustrated. However, the present invention is not limited thereto. For example, the sheet processing apparatus may be integrally included into the image forming apparatus main body. By applying the present invention to such a sheet processing apparatus, similar effects can be obtained.

According to the present invention, the pressing portion enters the gap between the holding surfaces of the holding portion to perform the deforming process to the spine of the booklet. Therefore, there is no possibility that the spine of the booklet spreads to the outside of the booklet to become greater than the thickness of the booklet. The movement of the pressing portion is changed, and the pressing position is changed. Accordingly, spines of booklets having any thickness can be crushed as being enclosed by the pressing member and the holding surfaces of the holding plates, resulting in that a good-looking corner can be formed even at the corner of the booklet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-232998, filed Oct. 7, 2009, and No. 2010-202574, filed Sep. 10, 2010, which are hereby incorporated by reference herein in their entirety.

What is claimed is:

1. A sheet processing apparatus comprising:

a holding portion that nips and holds a booklet, which includes folded sheets, by a pair of holding members opposite to each other;

a pressing portion comprising a pressing member having a thickness smaller than a thickness of the booklet held by the holding portion and configured to enter a gap between the pair of holding members to press a spine of the booklet held by the holding portion while moving along the spine of the booklet so as to deform the spine of the booklet; and a controlling portion configured to control movement of the pressing member such that (i) a moving direction of the pressing member along the spine of the booklet is changed and (ii) a pressing position of the pressing member in a thickness direction of the booklet held between the pair of holding members is changed, when the pressing portion deforms the spine of the booklet.

2. The sheet processing apparatus according to claim 1, wherein the pressing portion includes a plurality of pressing members, each having a different thickness in the thickness direction of the booklet, and wherein the controlling portion selects a pressing member, of the plurality of pressing members, to enter the gap between the pair of holding members which has a thickness closest to the thickness of the booklet held by the holding portion.

3. The sheet processing apparatus according to claim 2, wherein the plurality of pressing members respectively enter the gap between the pair of holding members to a progressively greater extent as a thickness of the gap increases.

4. The sheet processing apparatus according to claim 1, wherein the pressing member changes its moving direction along the spine of the booklet at a position outside the end of the booklet in the moving direction.

5. The sheet processing apparatus according to claim 4, wherein the pressing position in the thickness direction of the booklet is changed when the moving direction, after a predetermined number of times of movement of the pressing member, is changed.

6. The sheet processing apparatus according to claim 4, wherein the pressing position in the thickness direction of the booklet is changed when the moving direction of the pressing member, in the same direction of the reciprocating movement is changed.

7. The sheet processing apparatus according to claim 1, wherein the pressing position of the pressing member in the thickness direction of the booklet includes a position where the pressing member is in contact with one of the holding members and a position where the pressing member is in contact with the other holding member.

8. The sheet processing apparatus according to claim 1, further comprising:

a positioning portion that positions the spine of the booklet at a predetermined location, wherein the pressing portion presses the spine of the booklet positioned by the positioning portion.

9. The sheet processing apparatus according to claim 8, wherein the positioning portion has an entering amount to the gap between the pair of holding members smaller than that of an entering amount of the pressing member.

10. An image forming system comprising:

an image forming portion that forms an image on a sheet; and a sheet processing portion that selectively performs a process to the sheet having an image formed thereon, wherein the sheet processing portion includes:

a holding portion that nips and holds a booklet, which includes folded sheets, by a pair of holding members opposite to each other;

a pressing portion comprising a pressing member having a thickness smaller than a thickness of the booklet held by the holding portion and configured to enter a gap between the pair of holding members to press a spine of the booklet held by the holding portion while moving along a spine of the booklet so as to deform the spine of the booklet; and a controlling portion configured to control movement of the pressing member such that (i) a moving direction of the pressing member along the spine of the booklet is changed, and (ii) a pressing position of the pressing member in a thickness direction of the booklet held between the pair of holding members is changed, when the pressing portion deforms the spine of the booklet.

11. The image forming system according to claim 10, wherein the pressing portion includes a plurality of pressing members, each having a different height in the thickness direction of the booklet, and wherein the controlling portion selects a pressing member, of the plurality of pressing members, to enter the gap between the pair of holding members which has a thickness closest to the thickness of the booklet held by the holding portion.

12. The image forming system according to claim 11, wherein the plurality of pressing members respectively enter the gap between the pair of holding members to a progressively greater extent, as the thickness of the gap increases.

13. The image forming system according to claim 10, wherein the pressing member changes its moving direction along the spine of the booklet at a position outside the end of the booklet in the moving direction.

14. The image forming system according to claim 13, wherein the pressing position in the thickness direction of the booklet is changed when the moving direction, after a predetermined number of times of movement of the pressing member, is changed.

15. The image forming system according to claim 13, wherein the pressing position in the thickness direction of the booklet is changed when the moving direction of the pressing member, in the same direction of the reciprocating movement, is changed.

16. The image forming system according to claim 10, wherein the pressing position of the pressing member in the thickness direction of the booklet includes a position where the pressing member is in contact with one of the holding members and a position where the pressing member is in contact with the other holding member.

17. The image forming system according to claim 10, further comprising:

a positioning portion that positions the spine of the booklet at a predetermined location, wherein the pressing portion presses the spine of the booklet positioned by the positioning portion.

18. The image forming system according to claim 17, wherein the positioning portion has an entering amount to the gap between the pair of holding members smaller than that of an entering amount of the pressing member.

* * * * *